US012644664B1

(12) United States Patent
Maschin et al.

(10) Patent No.: US 12,644,664 B1
(45) Date of Patent: Jun. 2, 2026

(54) HOPPER STOCK PROJECTILES MAGAZINE APPARATUS AND METHODS FOR TOY BLASTER SYSTEM

(71) Applicant: Hasbro, Inc., Pawtucket, RI (US)

(72) Inventors: Robert C Maschin, Johnston, RI (US); Philip Sweeting, Medford, MA (US); David Drew Weiand, Johnston, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 19/019,871

(22) Filed: Jan. 14, 2025

Related U.S. Application Data

(60) Provisional application No. 63/568,322, filed on Mar. 21, 2024, provisional application No. 63/551,443, filed on Feb. 8, 2024.

(51) Int. Cl.
*F41B 11/89* (2013.01)
*F41B 11/55* (2013.01)
*F41B 11/73* (2013.01)

(52) U.S. Cl.
CPC ..... *F41B 11/89* (2013.01); *F41B 11/55* (2013.01); *F41B 11/73* (2013.01)

(58) Field of Classification Search
CPC ..... F41B 11/89; F41B 11/00; F41B 11/64; F41B 11/642; F41B 11/68; F41B 11/55; F41B 11/73
See application file for complete search history.

(56) References Cited

U.S. PATENT DOCUMENTS

| | | | | |
|---|---|---|---|---|
| 46,617 | A | 3/1865 | Allen | |
| 159,609 | A | 2/1875 | Prescott | |
| 956,760 | A | 5/1910 | Moulin | |
| 1,441,975 | A | 1/1923 | Edelin | |
| 1,488,995 | A | 4/1924 | McCollom | |
| 1,743,576 | A | 1/1930 | Smith | |
| 1,873,677 | A | 8/1932 | Traver | |
| 1,995,493 | A | 3/1935 | Ardiff | |
| 2,214,224 | A | 9/1940 | Douglas | |
| 2,293,957 | A * | 8/1942 | Wells | F41B 11/723 42/106 |
| 2,483,752 | A | 10/1949 | Buhl | |

(Continued)

FOREIGN PATENT DOCUMENTS

WO WO-2012148534 A1 * 11/2012 ..... F41B 11/51

*Primary Examiner* — Benjamin P Lee
(74) *Attorney, Agent, or Firm* — Perry Hoffman

(57) ABSTRACT

Launcher system with apparatus and methods for a toy projectile blaster removably interfaced with shoulder or butt stock receptacle hopper for multiple additional projectiles, user operable providing a hopper receptacle passageway in alignment with a firing projectile launching element to a projectile launching barrel for discharging projectiles. The pre-firing area allows projectile rounds to be received, while coupling the hopper stock projectiles magazine holds projectiles located distally along an upper portion of the pre-firing area for communication to outwardly launch the received projectile rounds. A user operable barrier at the hopper stock projectiles magazine receptacle opens and feeds by gravity into the pre-firing area The hopper stock projectiles magazine receptacle tilts towards the breech for feeding received projectile received into the pre-firing area.

20 Claims, 26 Drawing Sheets

(56) References Cited

U.S. PATENT DOCUMENTS 2,633,838 A * 4/1953 Seward ..... F41B 11/51 124/67
2,634,717 A 4/1953 Junkin
2,725,868 A 12/1955 Foster
2,737,942 A 3/1956 Horowitz et al.
3,054,536 A 9/1962 Sagarin
3,171,020 A 2/1965 Lord
3,262,440 A 7/1966 Kuhn
3,385,279 A 5/1968 Pitcher
3,420,133 A 1/1969 Proll
3,584,614 A 6/1971 Horvath
3,847,132 A 11/1974 Schatz
3,990,426 A 11/1976 Stokes
4,094,294 A 6/1978 Speer
4,345,578 A 8/1982 Speer
4,597,527 A 7/1986 Sands
4,774,929 A 10/1988 Millman
4,841,945 A 6/1989 Braden
4,848,307 A * 7/1989 Tsao ..... F41B 11/54 124/66
4,890,404 A * 1/1990 Ferri ..... F41C 3/12 124/2
5,205,271 A 4/1993 Salva
5,244,153 A 9/1993 Kuhn et al.
5,267,549 A 12/1993 Webber
5,320,207 A 6/1994 Abe
5,337,504 A 8/1994 Krumm
5,343,850 A 9/1994 Steer
5,415,151 A 5/1995 Fusi et al.
5,471,967 A 12/1995 Matsuzaki et al.
5,511,333 A * 4/1996 Farrell ..... F41B 11/55 42/49.01
5,529,050 A 6/1996 D'Andrade
5,535,729 A 7/1996 Griffin et al.
5,645,038 A * 7/1997 Luk ..... F41B 11/642 124/67
5,704,150 A 1/1998 Millman
5,878,734 A 3/1999 Johnson et al.
6,119,671 A 9/2000 Smith et al.
6,220,237 B1 * 4/2001 Johnson ..... F41B 11/89 124/75
6,460,530 B1 10/2002 Backeris et al.
6,488,019 B2 12/2002 Kotsiopoulos
7,017,569 B2 3/2006 Jong
7,051,727 B2 5/2006 Wu
8,082,909 B2 12/2011 Sopinsky et al.
8,113,188 B2 2/2012 Ma
8,127,753 B1 3/2012 Brooks et al.
8,127,754 B1 3/2012 Johnson et al.
8,336,531 B2 12/2012 Fan et al.
8,371,282 B2 * 2/2013 Meggs ..... F41B 11/641 124/56
8,397,705 B2 3/2013 DeHaan et al.
8,567,378 B2 10/2013 Nugent
8,640,683 B2 2/2014 Meggs et al.
8,695,579 B2 4/2014 Huebl
8,720,426 B2 * 5/2014 Hadley ..... F42B 12/74 124/66
8,875,688 B2 11/2014 Nugent
8,875,689 B2 11/2014 Chor-Ming
9,097,476 B2 8/2015 Mead et al.
9,097,477 B1 8/2015 Mead et al.
9,389,042 B1 7/2016 Clayton
9,500,436 B2 11/2016 Macy
9,587,903 B2 3/2017 Sullivan et al.
9,952,016 B2 4/2018 Sullivan
9,958,230 B1 5/2018 Nugent et al.
10,094,630 B1 10/2018 Loveday et al.
10,488,143 B2 11/2019 Victor et al.
10,488,146 B2 11/2019 Quek
10,488,148 B2 11/2019 Johnson et al.
10,823,527 B2 11/2020 Tino et al.
10,876,809 B1 12/2020 Kopman et al.
10,907,929 B2 2/2021 Bernal
11,033,805 B2 6/2021 Bernal
11,346,624 B2 * 5/2022 DeRoche ..... F41A 9/02
11,466,958 B2 10/2022 Bernal
11,592,259 B1 2/2023 Davis et al.
11,732,997 B2 * 8/2023 Buckmaster ..... F41B 11/55 124/52
12,422,214 B1 * 9/2025 Maschin ..... F41B 11/641
2002/0166551 A1 11/2002 Lee
2004/0123856 A1 7/2004 Finstad
2007/0034197 A1 2/2007 Tschech
2009/0095272 A1 4/2009 Zimmerman
2009/0145412 A1 6/2009 Barish
2010/0206281 A1 8/2010 Kanitz et al.
2011/0265775 A1 * 11/2011 Maeda ..... F41B 11/723 124/73
2011/0271940 A1 * 11/2011 Meggs ..... F41B 11/641 124/56
2012/0216786 A1 * 8/2012 Hadley ..... F41B 11/646 124/66
2013/0112184 A1 5/2013 Corsiglia et al.
2013/0146043 A1 6/2013 Zarecky et al.
2013/0312722 A1 11/2013 Price
2016/0018184 A1 1/2016 Park
2016/0320158 A1 * 11/2016 Hadley ..... F41B 11/723
2017/0336168 A1 * 11/2017 Hadley ..... F42B 12/74
2022/0128329 A1 * 4/2022 Buckmaster ..... F41B 11/55
2022/0268550 A1 8/2022 Bernal
2023/0221091 A1 7/2023 Davis et al.
2024/0328748 A1 * 10/2024 Sweeting ..... F41B 11/73

* cited by examiner

HOPPER STOCK PROJECTILES MAGAZINE APPARATUS AND METHODS FOR TOY BLASTER SYSTEM

FIELD OF THE INVENTION

The present invention relates generally to launcher apparatus and methods for a toy projectile blaster discharging projectiles such as foam rounds, balls, and flexible projectiles including hydrated super absorbent polymer (SAP) beads, and more particularly, hopper stock projectiles magazine apparatus and methods for toy blaster systems for discharging plural projectile rounds in a novel fashion providing an interfacing hopper stock projectiles magazine receptacle for holding multiple projectiles located distally along an upper or end portion of the a toy projectile blaster.

BACKGROUND OF THE INVENTION

Toys are often designed to have play value by simulating a real object, safely and at a reasonable expense. Toy launch apparatus have been marketed as toys for decades and include such devices as water pistols, toy BB rifles, foam projectiles, balls discs, dart blasters and NERF® brand launchers that discharge a soft foam dart. Most air launchers discharging projectiles use a launch spring and a piston and cylinder arrangement to generate the energy and direct that energy to cause the projectile to discharge. The launching apparatus themselves come in various forms, including those simulating rifles, guns, machine gun, shotguns, bows, rocket launchers, grenade launchers and foam car launchers. Generally, from design and function standpoints control of the size and operation of an air chamber in the cylinder is desirable for efficiency and cost considerations.

Projectile launch mechanisms are known in the art and include mechanisms for launching toy darts, balls of various sizes, paint balls, etc. Known projectiles also include spheres of hydrated super absorbent polymer beads, such as those disclosed in U.S. Pat. Nos. 8,371,282 and 8,640,683. These patents are incorporated herein by reference. As explained in the patents, super absorbent polymer beads are able to absorb extremely large amount of liquid relative to their own mass through hydrogen bonding with water molecules. Super absorbent polymer beads are soft projectiles that can maintain their shape under modest pressure such that they can be projected with reasonable force and velocity without breaking apart. Such super absorbent polymers are often referred to as "hydrogels" or simply as "gels." Examples of toy gel bead devices, marketed by Hasbro Inc., under the brands NERF® PRO GELFIRE™, and GEL BALL BLASTER™, stylized toy rifles that launches gel balls or 'gelfire' rounds. In the alternative made of NERF™ brand foam, a solid, spongy cellular material.

The inventions discussed in connection with the described embodiments address these and other deficiencies of the prior art. The features and advantages of the present inventions will be explained in or become apparent from the following summary and description of the preferred embodiments considered together with the accompanying drawings. The projectiles for such launching apparatus include soft foam darts of various designs and sizes, foam balls, also of various sizes, and other soft projectiles.

SUMMARY OF THE INVENTION

In accordance with the present invention, an advantageous method and apparatus are provided in the form of a toy launch apparatus designed to discharge soft projectiles, with an advantageous method and system described with improved hopper stock projectiles magazine apparatus and methods for toy blaster systems for discharging plural projectile rounds.

Briefly summarized, the inventions relate to a toy launching apparatus capable of launching projectile rounds interfacing a hopper stock projectiles magazine receptacle for holding multiple projectiles located distally along an upper or end portion of the toy projectile blaster in relation to a pre-firing area for communication to outwardly launch the received projectile rounds for advantageous and efficient configurable rotating barrier stock hopper at the firing mechanism housing for a projectile launching element use of a speed load stock additional hoppers or magazines.

Inventive magazine apparatus as disclosed are simply constructed with few and relatively inexpensive parts, providing quick and effective use with the toy projectile launcher and magazine interconnection apparatus as robust operational structure with either conventional or unconventional magazine hopper positioning, or with locations in unusual, angled orientations of the magazine to the launcher apparatus either atop or rearward thereof. Disclosed novel magazines facilitate quick and easy swapping of magazines or hoppers allowing projectile launcher interconnection and operation on the fly, further accommodating single hand user operation and quick release as may be best understood from the following detailed description taken in conjunction with the drawings and embodiments.

BRIEF DESCRIPTION OF DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
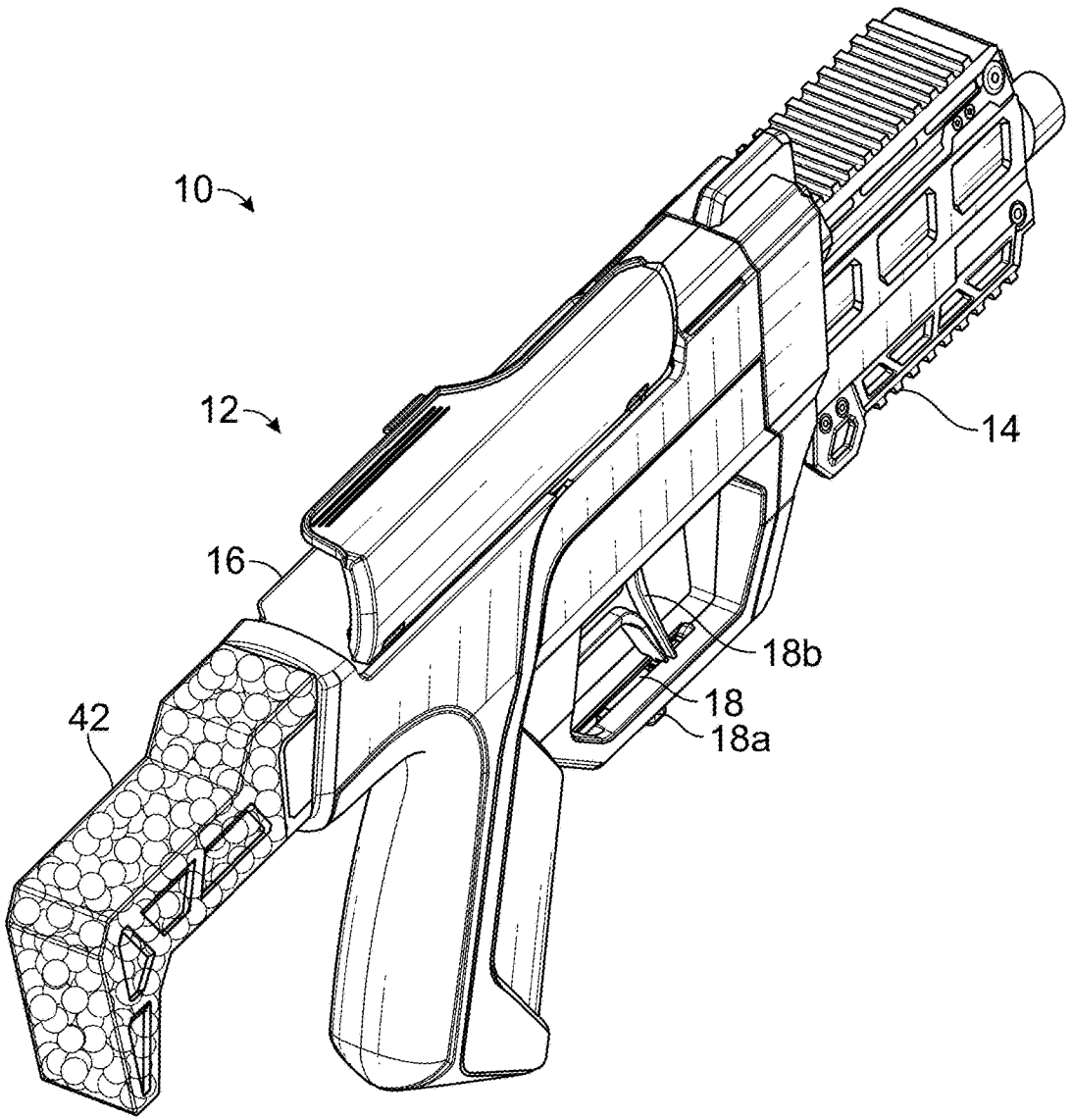
FIG. 1 is an isometric view of an assembled hopper stock projectiles magazine apparatus in a toy blaster for discharging plural projectile rounds launching toy projectile blaster embodiment employing top magazine hopper and removable hopper stock projectiles magazine receptacle for holding multiple projectiles located distally along an upper portion of the pre-firing area for projectiles with launching mechanisms in accordance with the present invention in the form of a blaster.
Figure 2A:
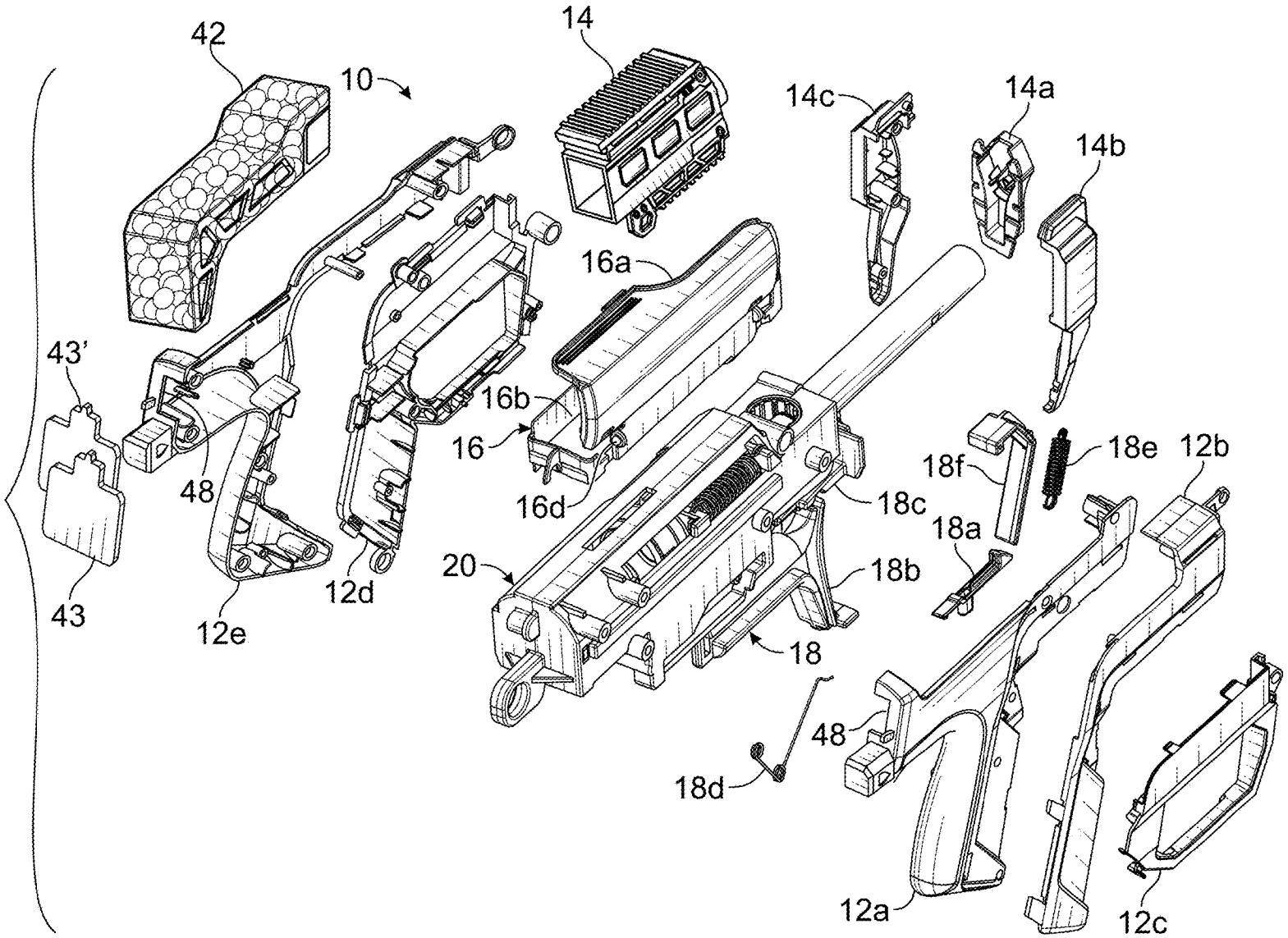
FIGS. 2A through 2G are exploded and assembly views of the blaster embodiments with an internal firing mechanism subassembly with FIGS. 3-7 showing views of the firing mechanism enabling toy projectile rounds to enter the pre-firing area, with hopper stock projectiles magazine apparatus in a toy blaster system for launching plural projectile rounds functions performed by a projectile discharging element.
Figure 2B:
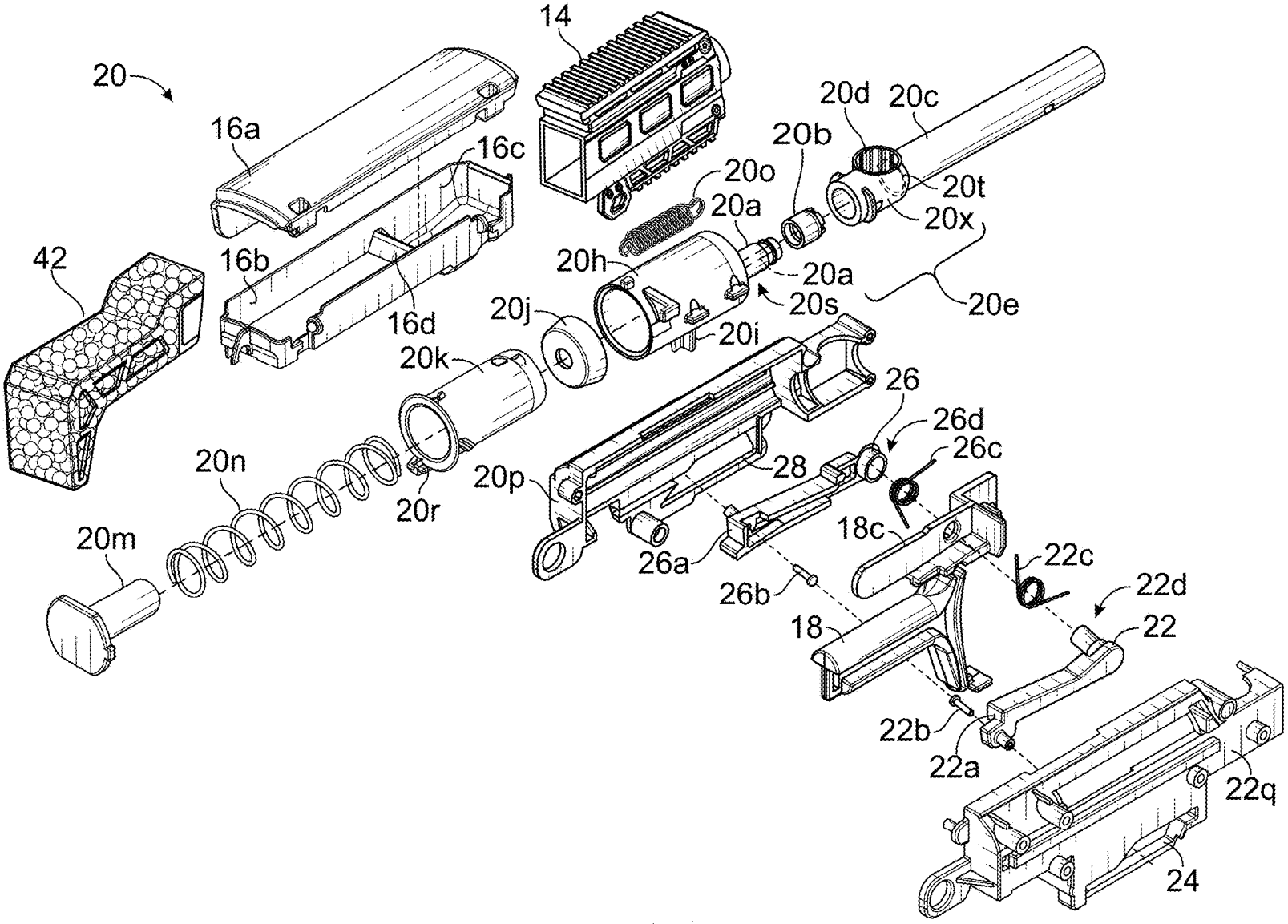
Figure 2C:
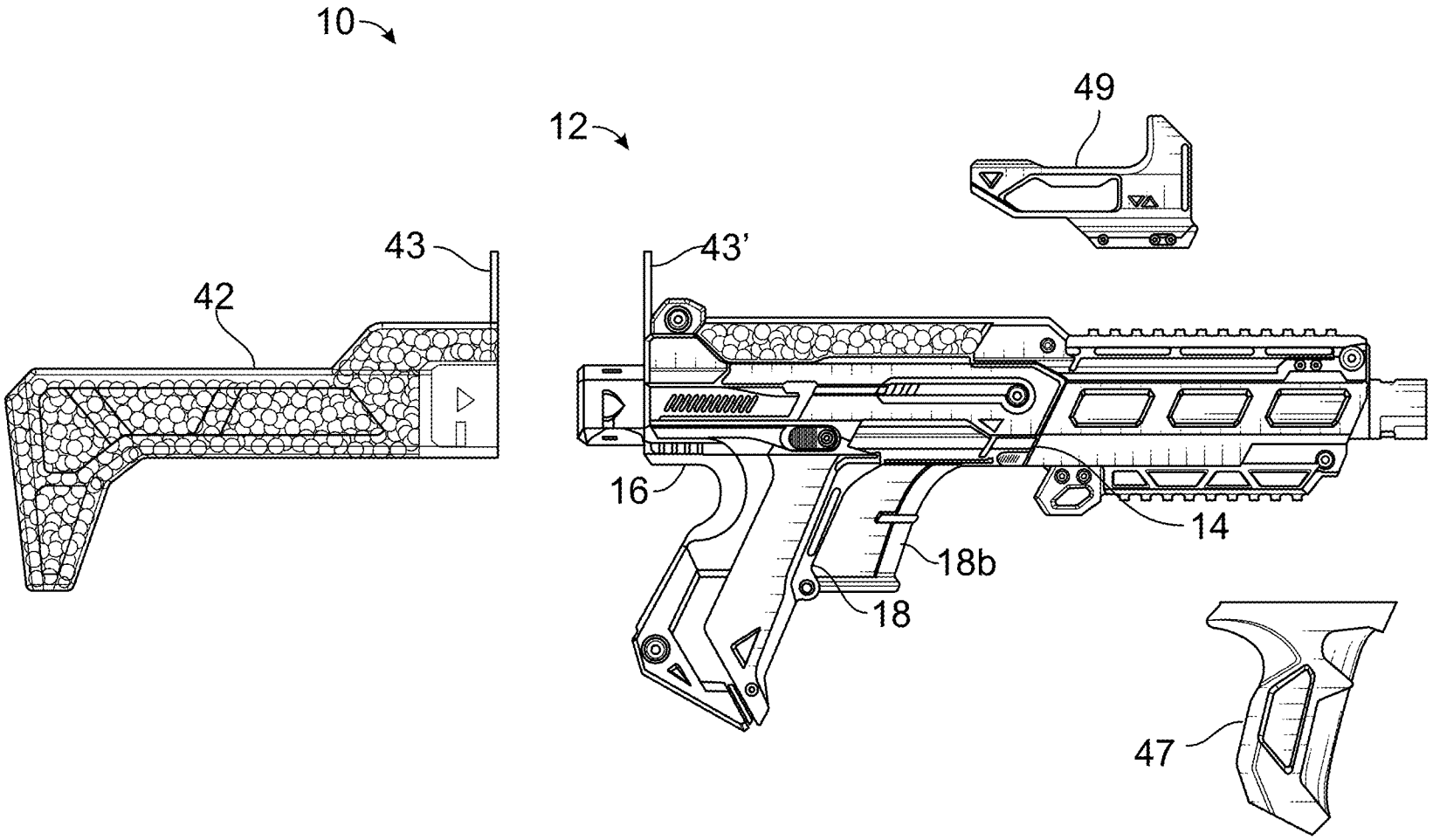
Figure 2D:
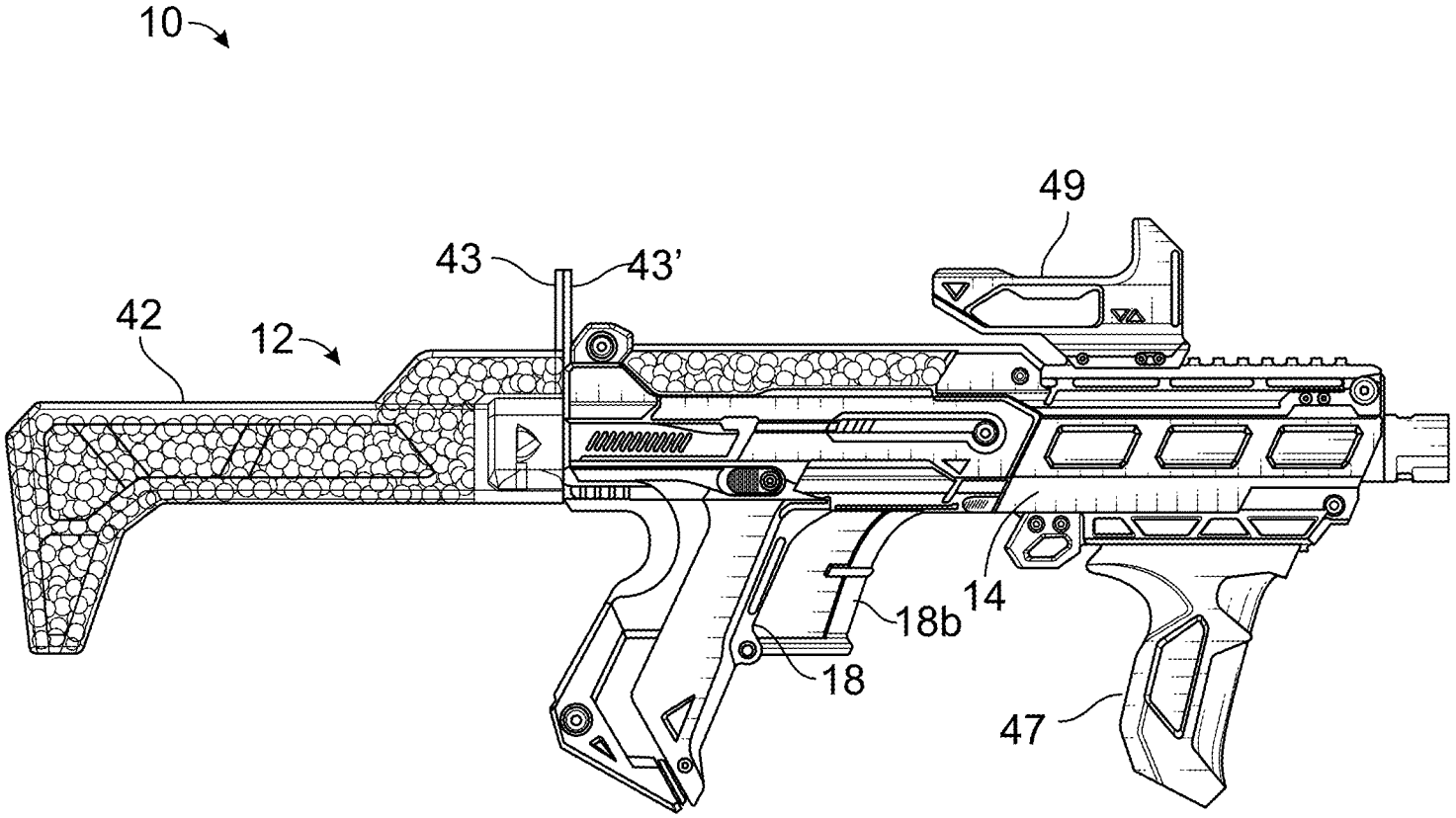
Figure 2E:
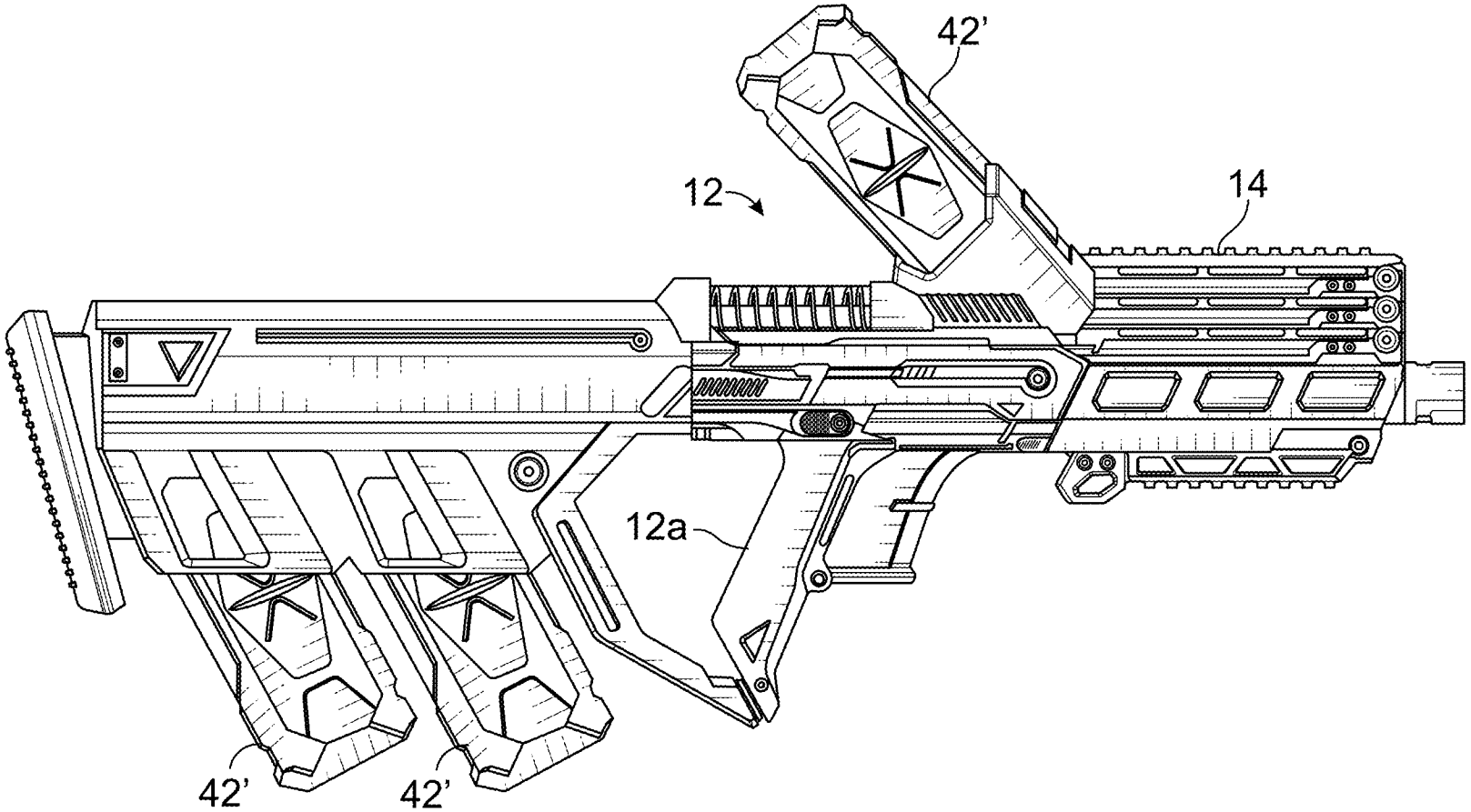
Figure 2F:
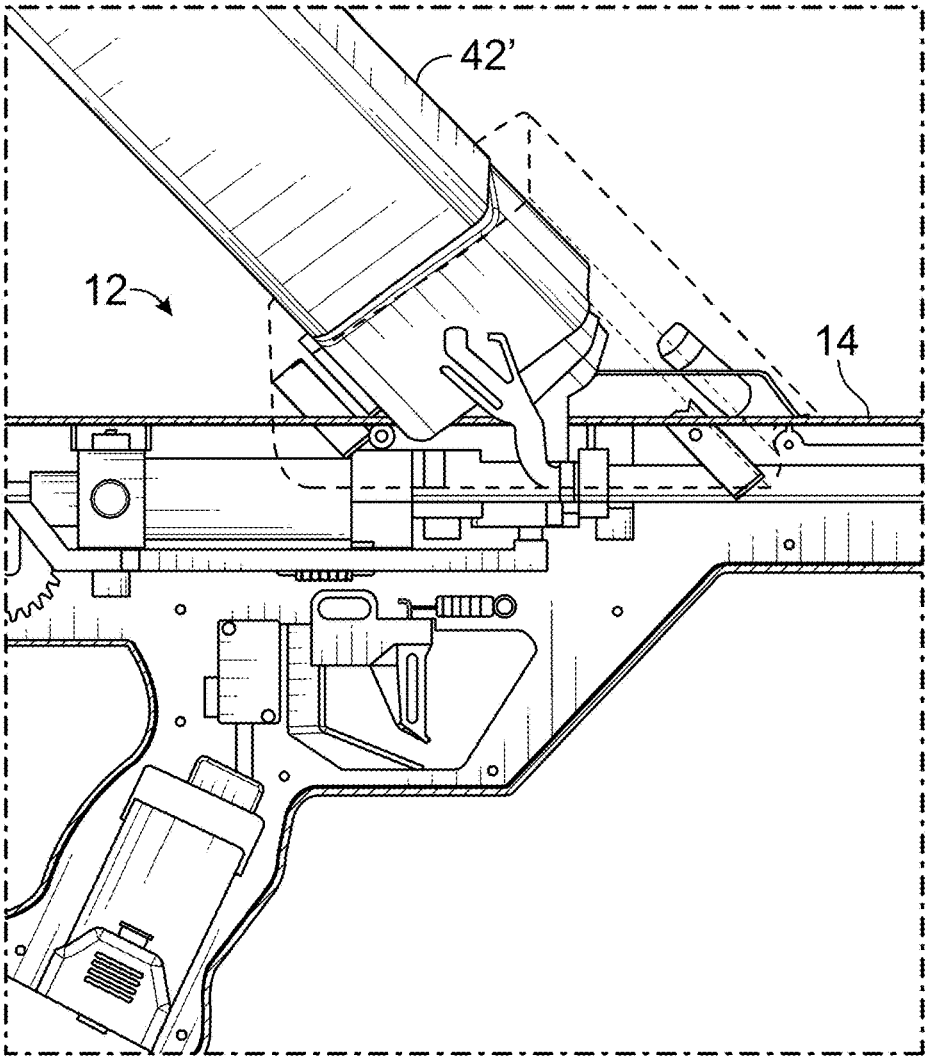
Figure 2G:
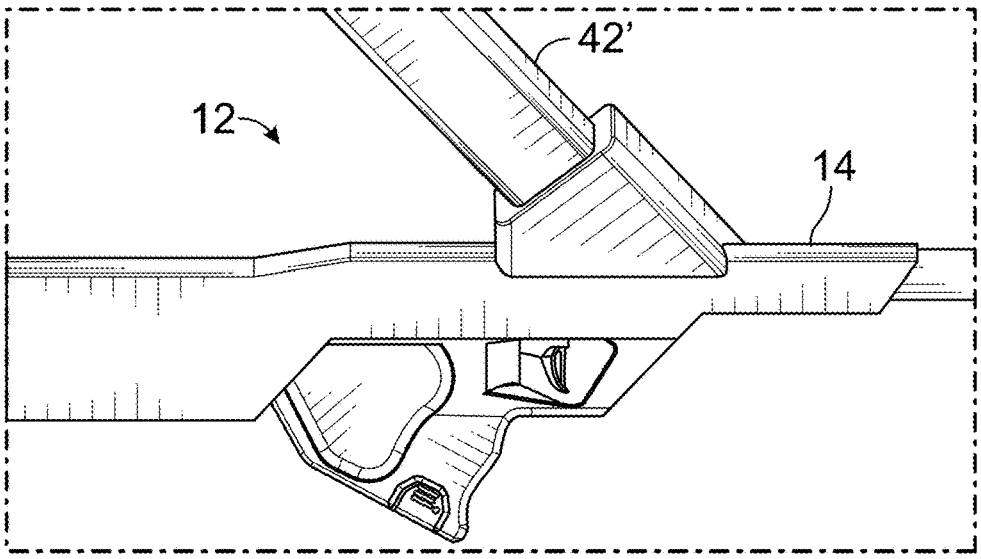

FIG. 1 is an isometric view of an assembled blaster 10 pneumatic launching toy with a structural side housing 12 in cross-section side housings shown as 30, 30' side housings, and further a structural muzzle housing 14 provides attachment rails for attaching a grip 47, or a sight 49. On the top there is a magazine or hopper 16 embodiment employing a gravity fed top hopper for rounds with triggering mechanisms. The rearwardly attachable shoulder butt stock 42 hopper housing is provided with a stock 42 interface and user operable interface wherein the hopper stock 42 projectiles magazine receptacle is removeable as a speed load stock 42 for a projectile launching element use of additional shoulder or butt stock 42, such that rounds from the magazine hopper will enter the breech of the blaster firing mechanism for advantageous and efficient configurable rotating barrier stock 42 hopper at the firing mechanism housing for a projectile launching element use of a speed load stock 42 additional hoppers or magazines. The trigger assembly 18 has two linkages that the user interacts with a cam follower linkages conveyor 18*c* of trigger 18*b* which is used to fire gel rounds with a functional lock switch 18*a* that activates to prevent the trigger from retracting. FIGS. 2A, 2B, and 2C show exploded views of the blaster 10 with an internal firing mechanism 20 subassembly. The firing mechanism subassembly 20 is not exploded in FIG. 2D. The exploded views of the firing mechanism 20 enables toy projectile rounds 40 to enter the pre-firing area 20*e*, with pneumatic launching functions performed by an air compression element 20*s* with a cylinder 20*h* and piston 20*k*. The side housing includes the right proximal housing 12*a*, right middle housing 12*b*, right grip housing 12*c*, left grip housing 12*d* and left proximal housing 12*e* of side housing 30. The muzzle housing 14 includes the middle muzzle housing 14*a*, right muzzle housing 14*b* and left muzzle housing 14*c*. FIGS. 2E through 2G are exploded and assembly views of the blaster embodiments with an internal firing mechanism subassembly. The top of the magazine hopper has a refill door and click in/out track for storage in the butt stock.

Figure 8A:
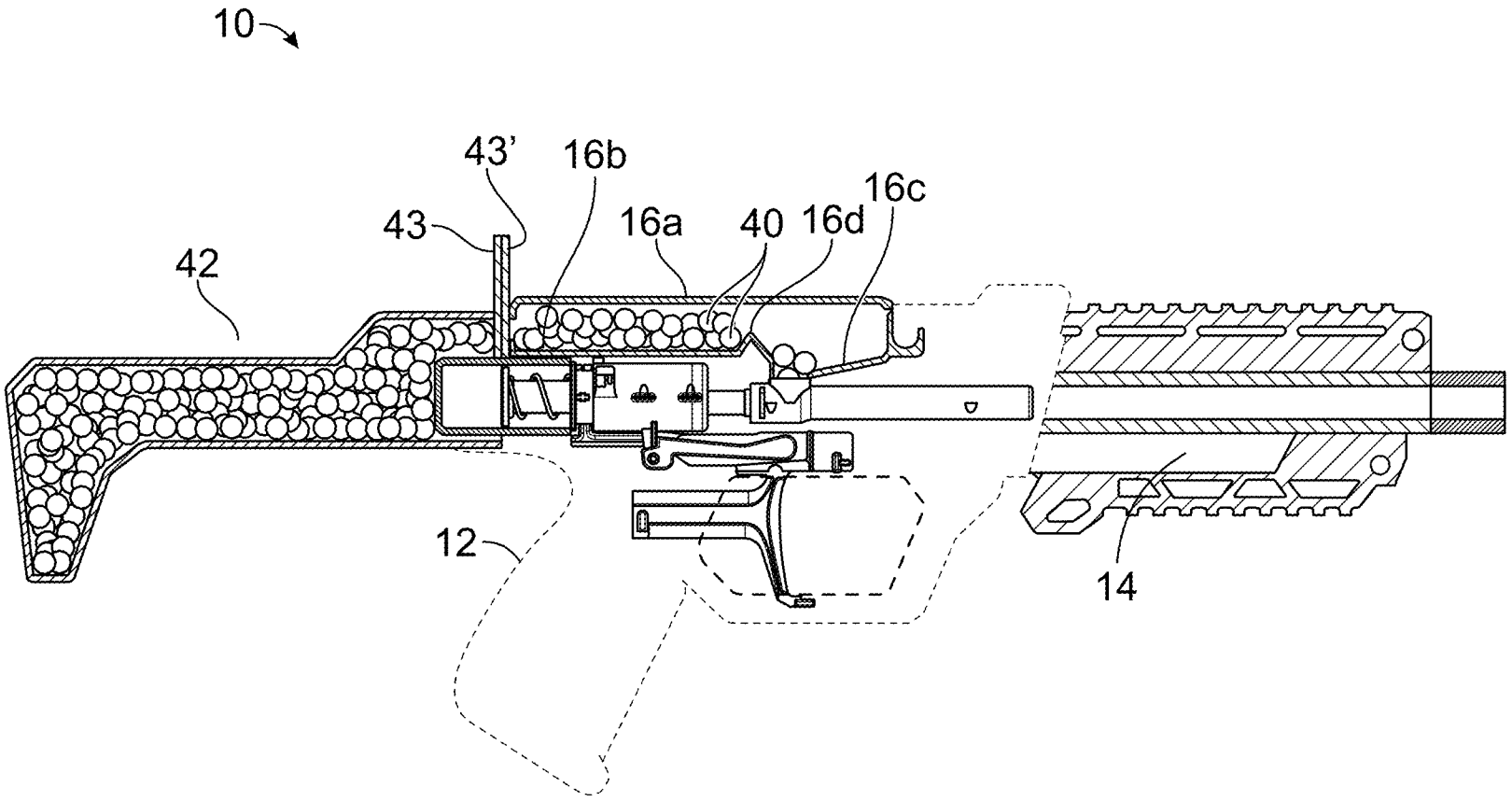
FIGS. 8A, 8B, and 8C show the use of the hopper with two separate areas facilitating reloading by tilting the blaster the use of the magazine back tray and magazine front hopper, such that rounds from the magazine front hopper will enter the breech of the blaster firing mechanism providing an interfacing hopper stock projectiles magazine receptacle for holding multiple projectiles located distally along an upper or end portion of the a toy projectile blaster in relation to a pre-firing area.
Figure 8B:
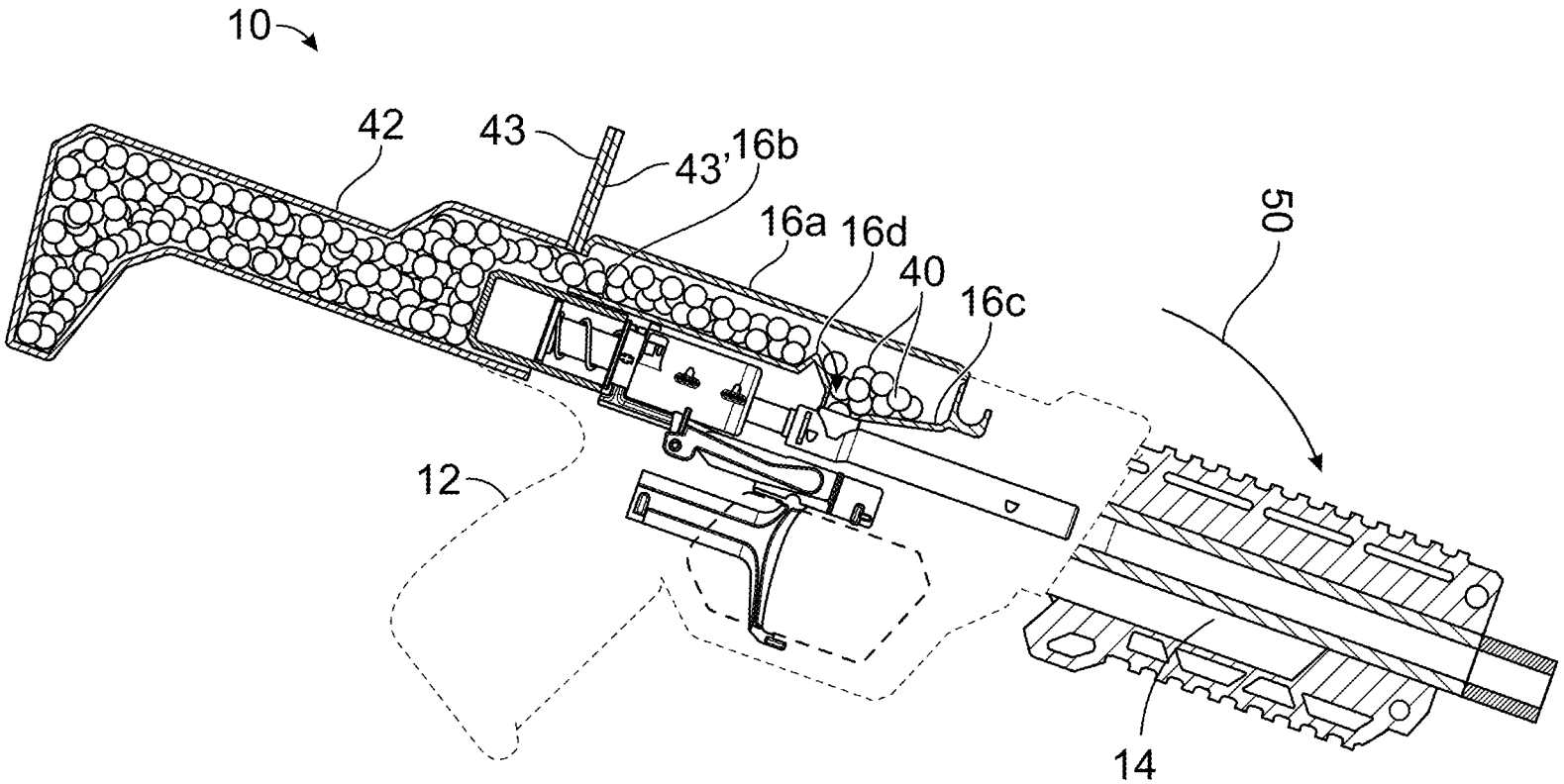
Figure 8C:
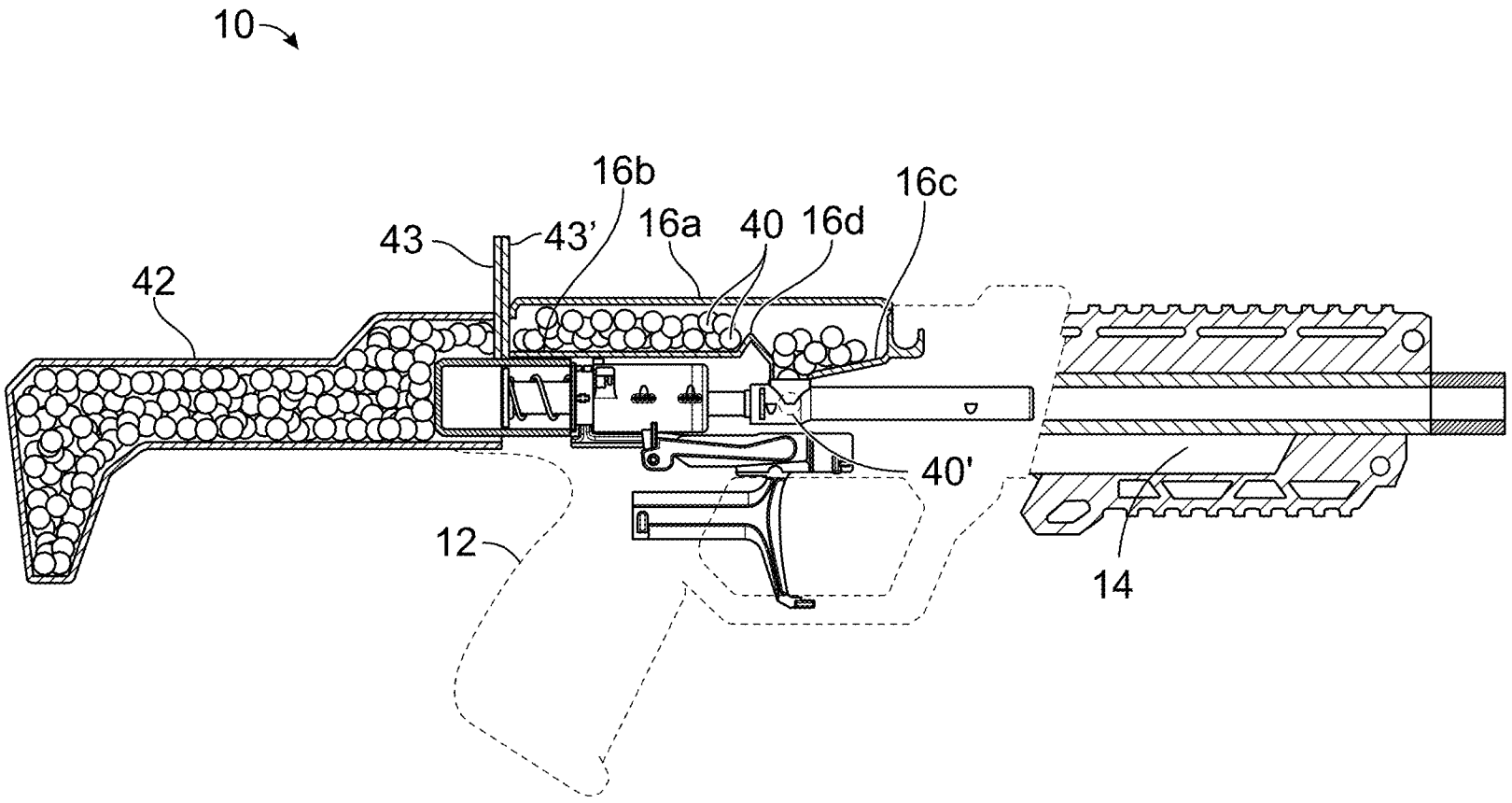
Figure 9:
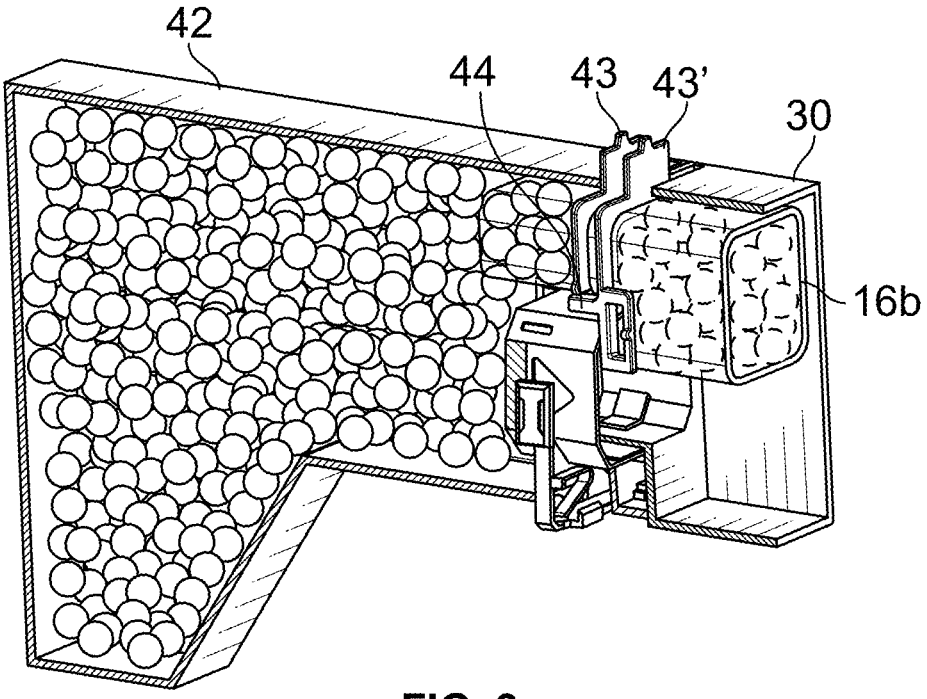
FIG. 9 show a rearwardly attachable shoulder butt stock hopper housing interface for a projectile launching element use of a speed load stock additional shoulder or butt stock, such that rounds from the magazine hopper will enter the breech of the blaster firing mechanism.
Figure 9A:
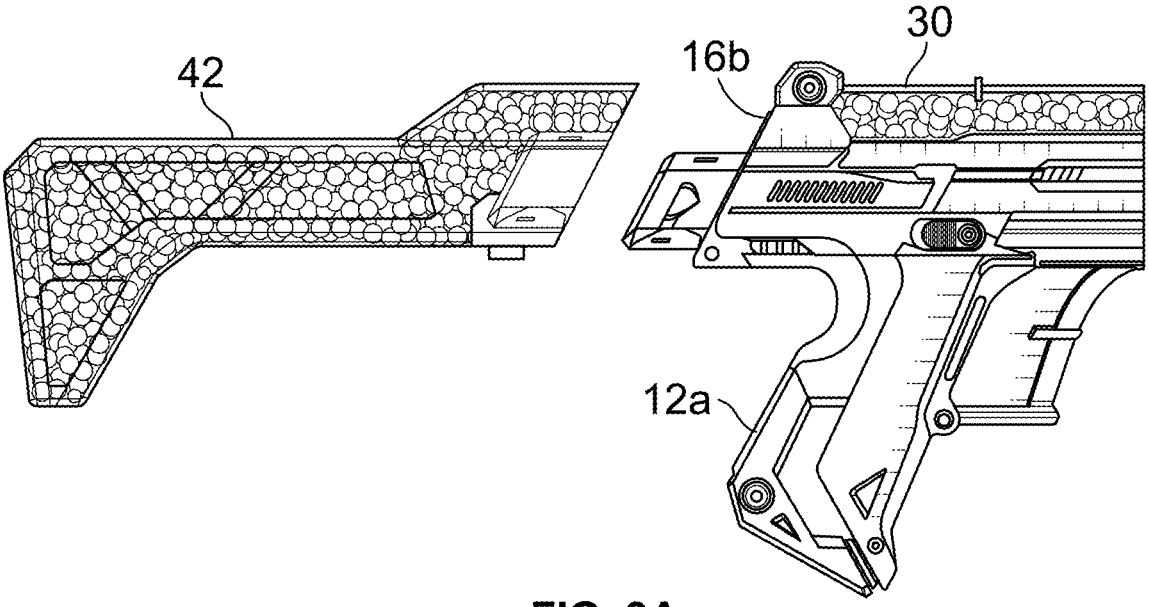
FIGS. 9A through 9G show a rearwardly attachable shoulder butt stock hopper housing interface to blaster housing with coupling to internal hopper for a projectile launching element use of a speed load stock additional shoulder or butt stock, such that rounds from the magazine hopper will enter the breech of the blaster firing mechanism for speed-tilt re-load in a Speed and Tilt Snap shoulder stock re-load.
Figure 9B:
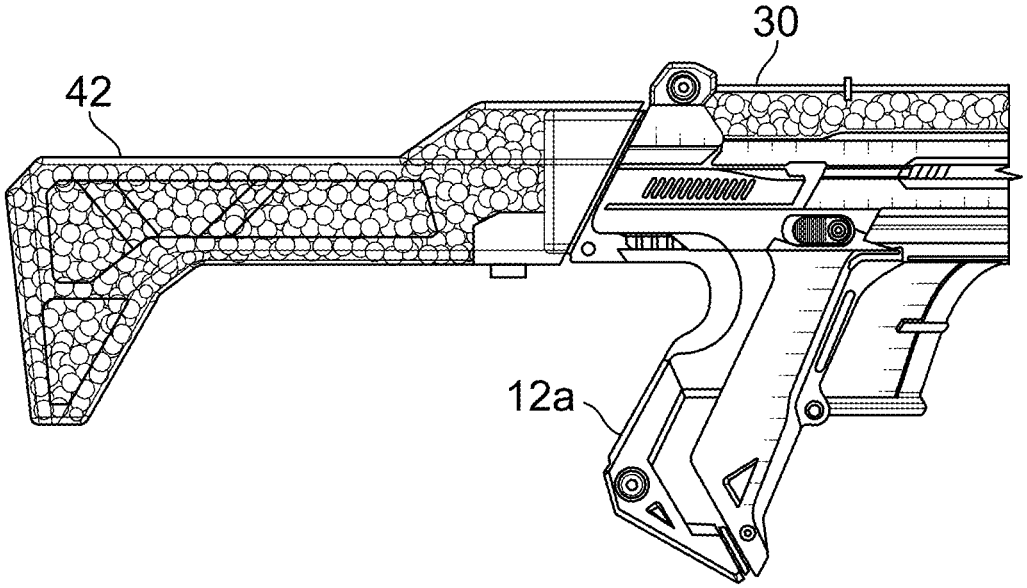
Figure 9C:
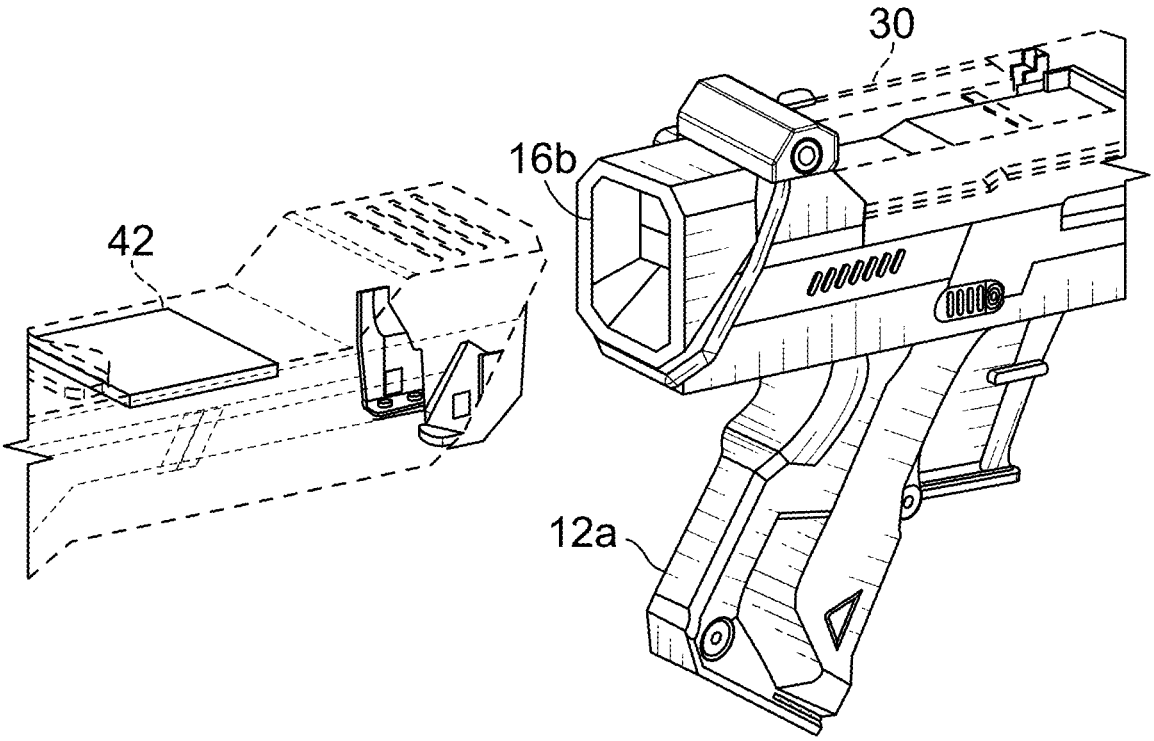
Figure 9D:
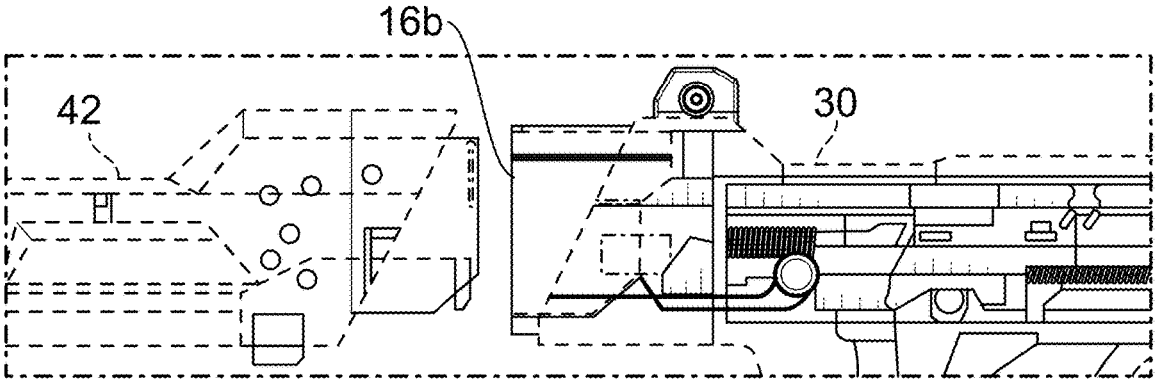
Figure 9E:
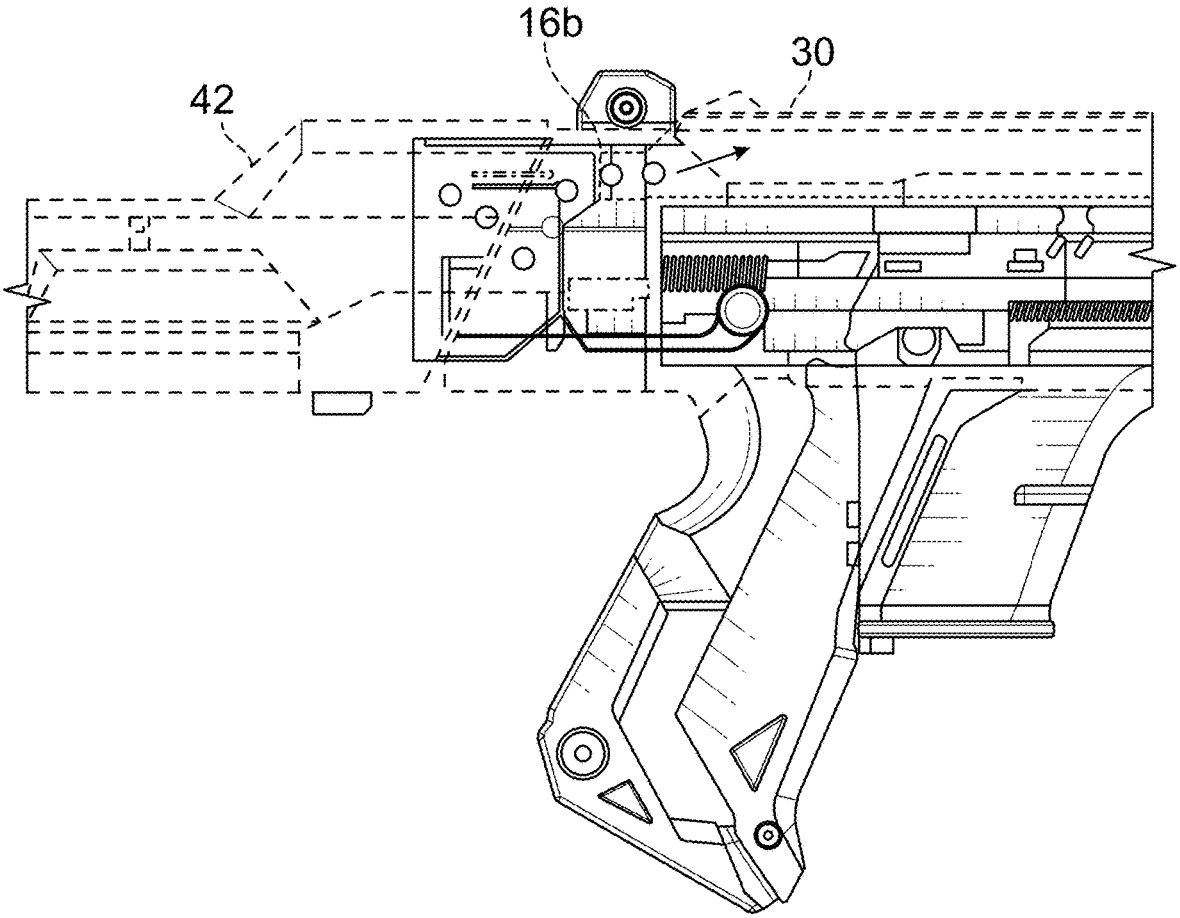
Figure 9F:
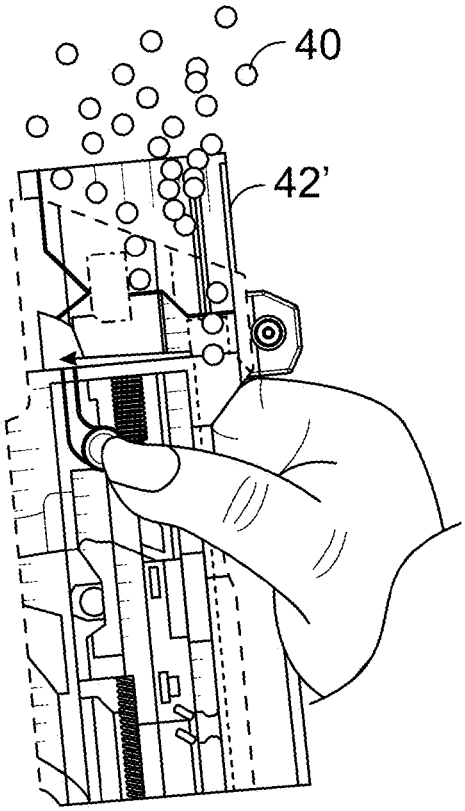
Figure 9G:
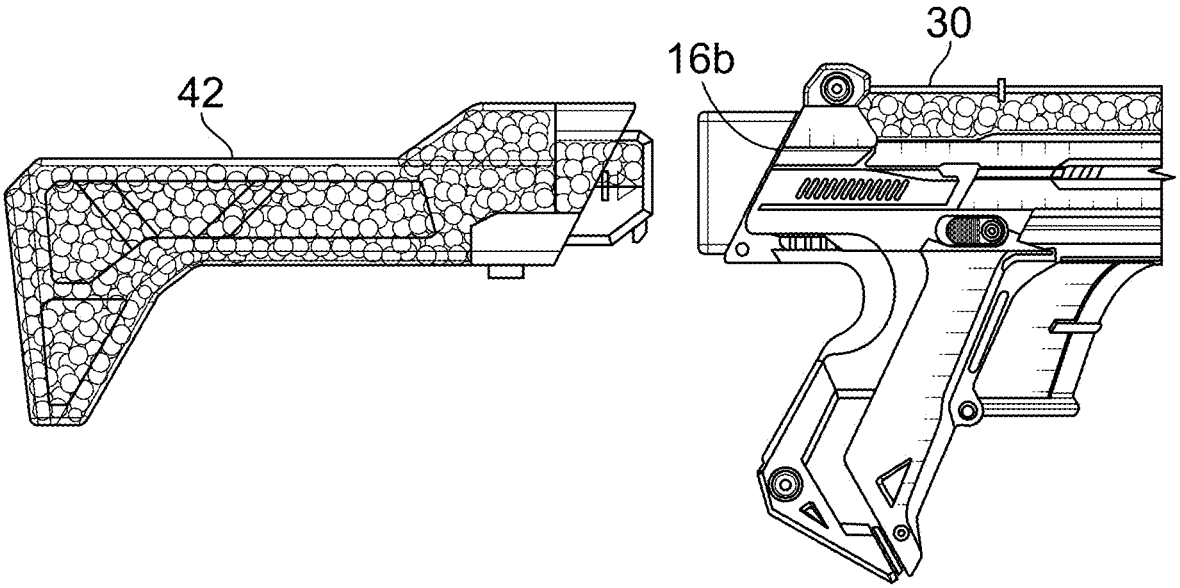
Figure 9H:
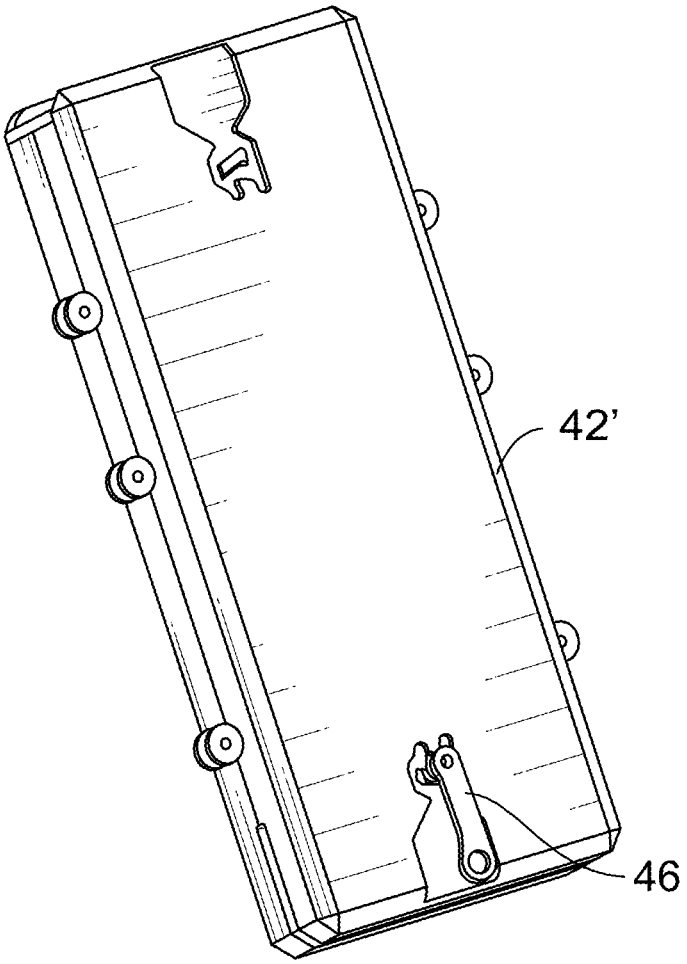
FIGS. 9H through 9M show an upwardly attachable gravity-feed snap-in/snap-out keyed hopper housing interface for insertion atop a blaster housing with coupling for a projectile launching element use of an alternative or additional speed load magazine, such that rounds from the magazine hopper will enter the breech of the blaster firing mechanism for speed re-load in a Speed and Snap In re-load.
Figure 9I:
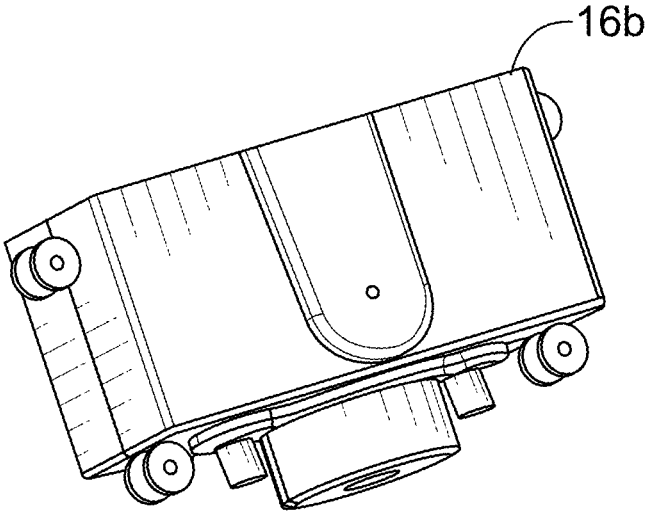
Figure 9J:
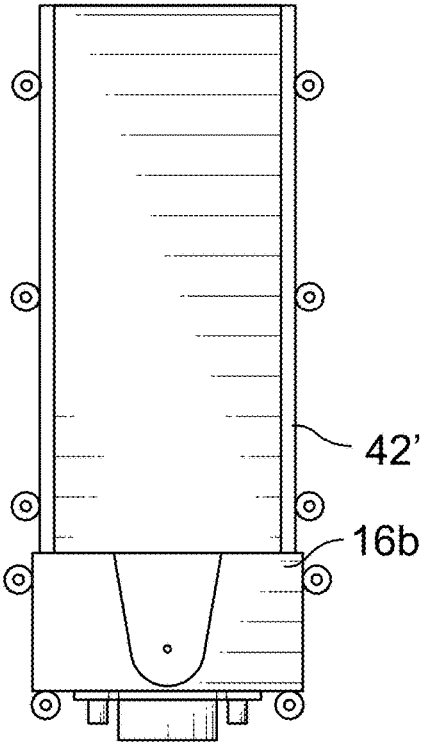
Figure 9K:
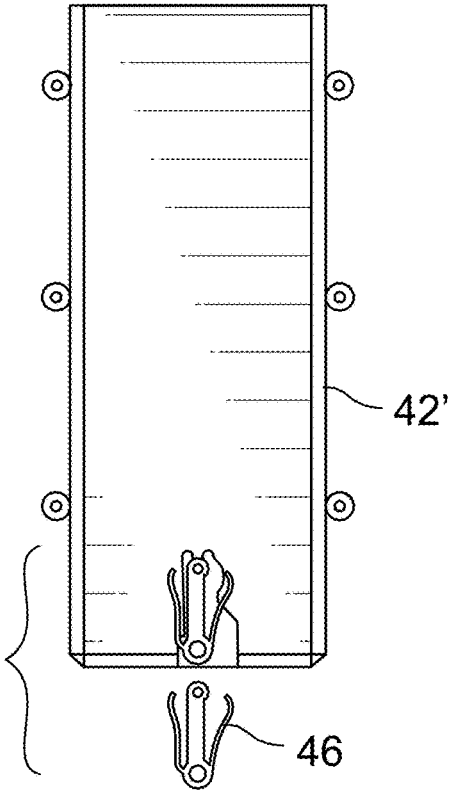
Figure 9L:
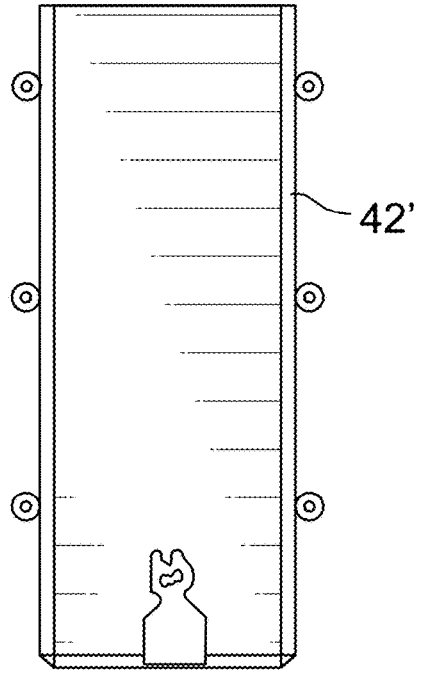
Figure 9M:
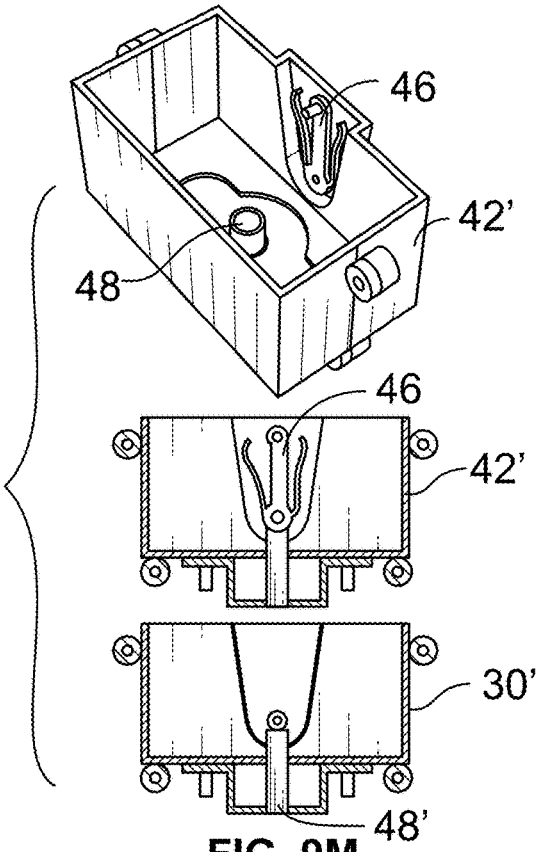

The hopper 16 has a hopper lid 16*a*, and multiple internal areas through door, flaps, or walls 43 mating apertures 48 with mechanical lever 44 communication to the hopper: magazine back tray 16*b* and magazine front hopper 16*c* (not shown in FIG. 2A). These internal areas hold gel rounds and are separated by magazine separator 16*d*. FIGS. 8A-8B progress blaster 10 toward tilting forward will allow gel rounds 40 to go over the magazine separator 16*d* from the magazine back tray 16*b* into the magazine front hopper 16*c*, for speed-tilt re-load in a Speed and Tilt Snap back shoulder stock 42 re-load. FIG. 8C shows blaster 10 being returned to a relatively flat tilt, with FIG. 8C shown to have many gel rounds 40 in the front magazine hopper 16*c*. The walls 43 to move to open and close corresponding apertures 48 with mechanical communication to function of the different hoppers or trays as described in more detail in FIGS. 8A, 8B, 8C. Trigger 18 contains a lock switch 18*a*, a trigger 18*b* and a conveyor 18*c*. Trigger 18*b* and conveyor 18*c* are part of the same integral component and are constrained to move in the longitudinal axis. Conveyor 18*c* attaches to the cylinder cam follower linkage 22 and piston cam follower linkage 26. Trigger lock linkage 18*f* latches onto the conveyor 18*c* when the lock switch 18*a* is activated and the trigger 18*b* is fully advanced. Trigger lock spring 18*e* is a spring that applies a biasing force on trigger lock linkage 18*f*. Returning trigger

18*d* is a torsion spring that applies a biasing force on the trigger 18*b*. Finally, firing mechanism 20 controls the firing of the gel round.

The firing mechanism 20 is responsible for enabling a gel round to enter the pre-firing 20*e* area, sealing a gel round in the pre-firing 20*e* area and firing the gel round. These functions are performed by the air compression element 20*s* and piston 20*k*. The air compression element 20*s* and piston 20*k* are constrained to move along the longitudinal axis by the firing mechanism housing. Both the air compression element 20*s* and piston 20*k* each have a cam follower linkage which controls their movement along the longitudinal axis. The air compression element 20*s* is responsible for opening and closing the entryway to the breech 20*d*. The piston 20*k* is responsible for firing the gel round. The firing mechanism is contained within the left firing mechanism housing 20*p* and the right firing mechanism housing 20*q*. Pre-firing area 20*e* holds the gel round prior to being fired. The pre-firing area 20*e* includes the breech 20*d* and the alignment passage 20*x*. The gel round enters the alignment passage 20*x* through the breech 20*d*. When the gel round is fired, the gel round is propelled into the projectile launching barrel 20*c* through the barrel seal 20*t*.

The air compression element 20*s* includes the breech bolt 20*a* and the cylinder 20*h*. When the air compression element 20*s* is in the advanced position, the breech bolt 20*a* extends into the pre-firing area 20*e*. The extension of the breech bolt 20*a* into the pre-firing area 20*e* blocks the breech 20*d*. Blocking the breech 20*d* prevents the gel round from exiting the pre-firing area 20*e* through the breech 20*d* and prevents additional gel rounds from entering the pre-firing area 20*e*. The breech bolt 20*a* has a distal end 20*u* and a proximal end 20*v*. The proximal end 20*v* is at the cylinder 20*h*. The breech bolt seal 20*b* attaches to the breech bolt distal end 20*u*. The gel round is held between the breech bolt seal 20*b* and the barrel seal 20*t* prior to firing. The distal end of the breech bolt 20*u* and the breech bolt seal 20*b* have a channel for fluid communication 20*w* with the alignment passage 20*x*. Since the inside of the cylinder 20*h* has fluid communication with the breech bolt 20*a*, the inside of the cylinder 20*h* has fluid communication with the alignment passage 20*x* through the fluid communication channel 20*w*. Air compression element 20*s* slidably receives the piston 20*k*.

The piston compresses the air within the air compression element 20*s* by rapidly sliding into the cylinder 20*h*. Since the inside of cylinder 20*h* has fluid communication with the breech bolt, if the cylinder 20*h* rapidly receives the piston 20*k* air will be rapidly expelled through the fluid communication channel 20*w* and the gel round will be pneumatically launched through the barrel 20*c*. The piston seal 20*j* attaches to the distal end of the piston 20*k*. The piston seal 20*j* reduces the friction when the cylinder 20*h* slidably receives the piston 20*k*. The outside of the piston 20*k* does not contact the inside of the cylinder 20*h*. Instead, the piston seal 20*j* contacts the inside of the cylinder 20*h*. The piston seal 20*j* reduces friction because it is lubricated. Piston seal 20*j* contacts the inside of the cylinder 20*h* to increase the air pressure inside the air compression element 20*s* during firing. Likewise, the outside of the breech bolt 20*a* does not contact the inside of the alignment passage 20*x*. Instead, the barrel seal 20*b* contacts the inside of the alignment passage 20*x*. The breech bolt seal 20*b* reduces friction because it is lubricated. Barrel seal 20*b* contacts the inside of the alignment passage 20*x* so that air that flows through the fluid communication channel 20*w* during firing continues through barrel 20*c*.

The firing mechanism controls when the breech bolt 20*a* blocks and unblocks the breech as well as when the piston 20*k* pneumatically firing the gel round. The firing mechanism operates with timing in five cyclic steps which dictate and drive the movement of the air compression element 20*s* and the piston 20*k*. Each step is activated as the trigger is pulled back. First, the air compression element 20*s* and piston 20*k* are fully advanced. The breech bolt 20*a* blocks the breech 20*d*. Second, the air compression element 20*s* and piston 20*k* both retract. The breech bolt 20*a* no longer blocks the breech 20*d* so a gel round can enter the pre-firing area 20*e*. Third, the piston 20*k* retracts while the air compression element 20*s* advances. The breech bolt 20*a* blocks the breech 20*d*. The gel round is sealed within the alignment passage 20*x* and any further gel rounds are prevented from entering the pre-firing area 20*e*. Fourth, the piston 20*k* quickly advances. The air inside the air compression element 20*s* suddenly compresses. Due to the pressure difference between the air in the air compression element 20*s* and the barrel 20*c*, the gel round is pneumatically propelled out of the barrel. Finally, both the air compression element 20*s* and piston 20*k* have fully advanced, hence completing the cycle.

Both the air compression element 20*s* and the piston 20*k* retract with the trigger at first. However, the air compression element 20*s* and piston 20*k* advance when the trigger has retracted enough. The trigger position for which the air compression element 20*s* and piston 20*k* advance are different. This retraction and advancement timing are controlled by two cam follower linkages; one for the air compression element 20*s* and one for the piston 20*k*. A breech bolt spring 200 and piston spring 20*n* attach to the cylinder 20*h* and the piston 20*k* respectively. These springs apply a biasing force on the air compression element 20*s* and piston 20*k*. Additionally, piston spring alignment 20*m* ensures piston spring 20*n* is in line with the piston 20*k*, air compression element 20*s* and barrel 20*c*. Cylinder cam follower linkage 22 and piston cam follower linkage 26 control the positions of the air compression element 20*s* and piston 20*k* respectively. The cam follower linkages control when the air compression element 20*s* and 20*k* retract and advance. The cam follower linkages are pivoted at the conveyor 18*c*. The cylinder cam follower linkage 22 is pivoted at the cylinder trigger end 22*d*. Likewise, the piston cam follower linkage 26 is pivoted at the piston trigger end 26*d*. The cam follower linkages are also constrained in a vertical plane. As such, when the trigger 18*b* retracts the cam follower linkages also retract.

The cam follower linkages may engage with the cylinder 20*h* or piston 20*k* to retract cylinder 20*h* or piston 20*k*. The cylinder cam follower linkage 22 has a cylinder follower coupling 22*a* which may engage with the cylinder driving coupling 20*r*. Likewise, the piston cam follower linkage 26 has a piston follower coupling 26*a* which may engage with the piston driving coupling 20*i*. When the follower couplings are engaged with their respective driving coupling, the follower couplings may apply a force on their respective driving couplings. If the trigger 18*b* is retracting while a follower coupling is engaged, air compression element 20*s* or the piston 20*k* will also retract. The cam follower linkages also track their respective cam pathway track. The cam pathway track may determine the rotation of the cam follower linkages and whether they are engaged with their driving couplings. The cylinder cam follower linkage 22 has a tracking end 22*b* which tracks the cylinder cam pathway track 24. Likewise, the piston cam follower linkage 26 has a tracking end 26*b* which tracts the piston cam pathway track 28. Cylinder biasing spring 22*c* and piston biasing spring

26*c* are torsional springs which apply a biasing force on the cylinder cam follower linkage 22 and piston cam follower linkage 26 respectively to raise and lower these follower linkages for their timing actuations. These biasing springs ensure that the tracking ends track their respective pathways. If the cam follower linkages retract enough, the cam pathway tracks cause the cam follower linkages to rotate and have the follower couplings disengage with their driving couplings. If disengagement occurs, only the biasing forces would be present on the air compression element 20*s* or the piston 20*k*; the air compression element 20*s* and piston 20*k* would quickly advance.

The follower couplings disengage with their driving couplings when the cam follower pathways move the tracking ends low enough. However, the follower couplings engage with their driving couplings when the cam follower pathways allow the tracking to be ends high enough and the follower couplings are in front of the driving couplings. In other words, retracting the cam follower linkages far enough will disengage the follower couplings from the driving couplings, but advancing the cam follower linkages far enough will not engage the follower couplings with the driving couplings until the follower couplings are in front of the driving couplings.

The difference between the air compression element 20*s* and piston 20*k* mechanisms is the time at which the follower couplings disengage with the driving couplings. The piston driving coupling 20*i* becomes unengaged when the trigger 18*b* retracts farther than where the cylinder driving coupling 20*r* becomes unengaged. In other words, the piston 20*k* becomes unengaged, and hence advances, at a later step than the air compression element 20*s*. The magazine lid 16*a*, back tray 16*b*, front tray 16*c* and the magazine separate 16*d* are shown more clearly in FIGS. 2B-2D.

Figure 3:
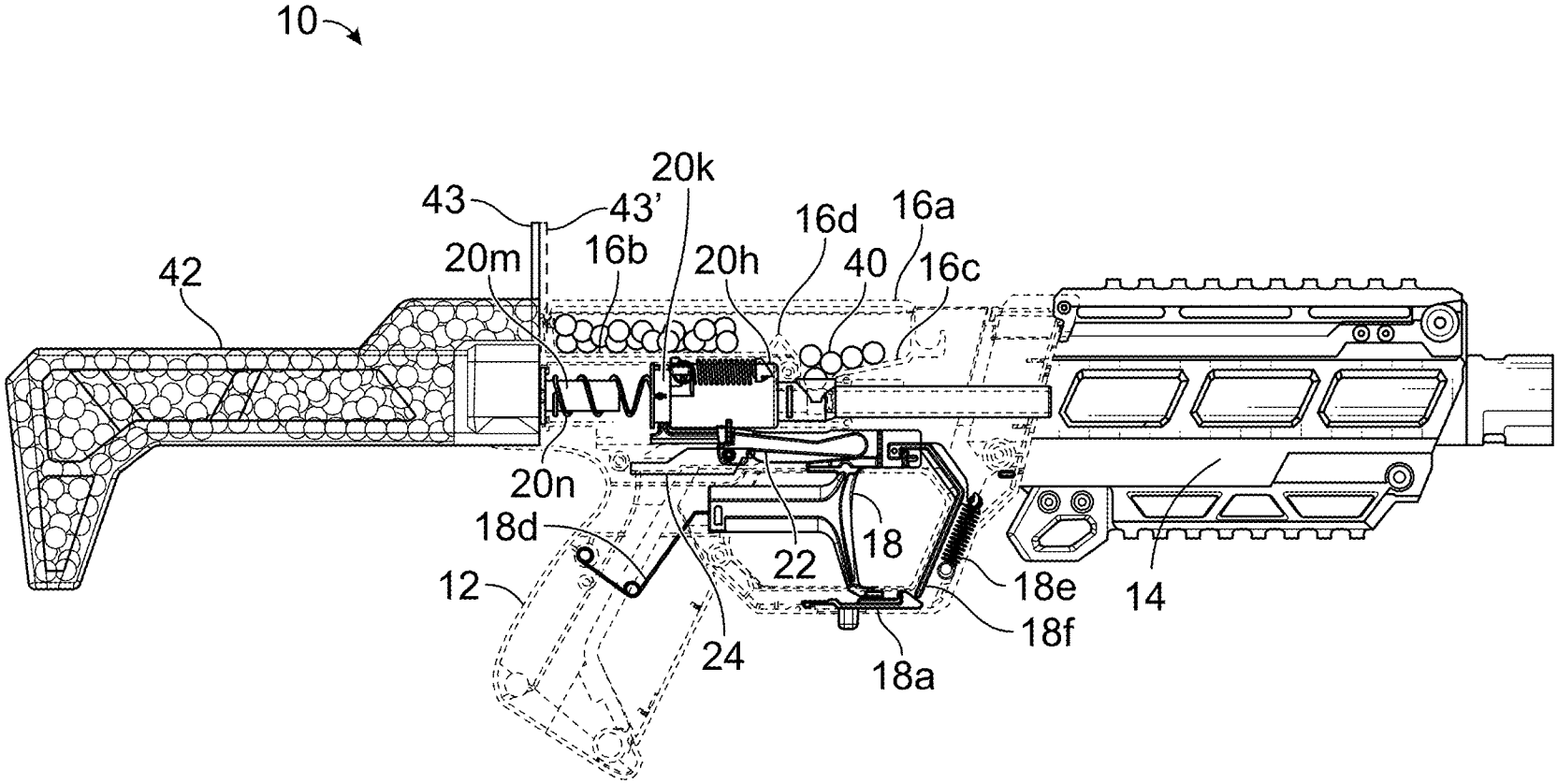
FIG. 3 show the blaster embodiment in side-elevation firing mechanism sectional and respective cylinder and piston cam pathway tracking/cam follower linkages in an initial trigger at rest first initial step firing mechanism illustrating functional projectile rounds conveyor interfaced with a hopper stock projectiles magazine receptacle for holding multiple projectiles located distally along an upper or end portion thereof in relation to a pre-firing area through use of the blaster trigger launch apparatus.
Figure 4:
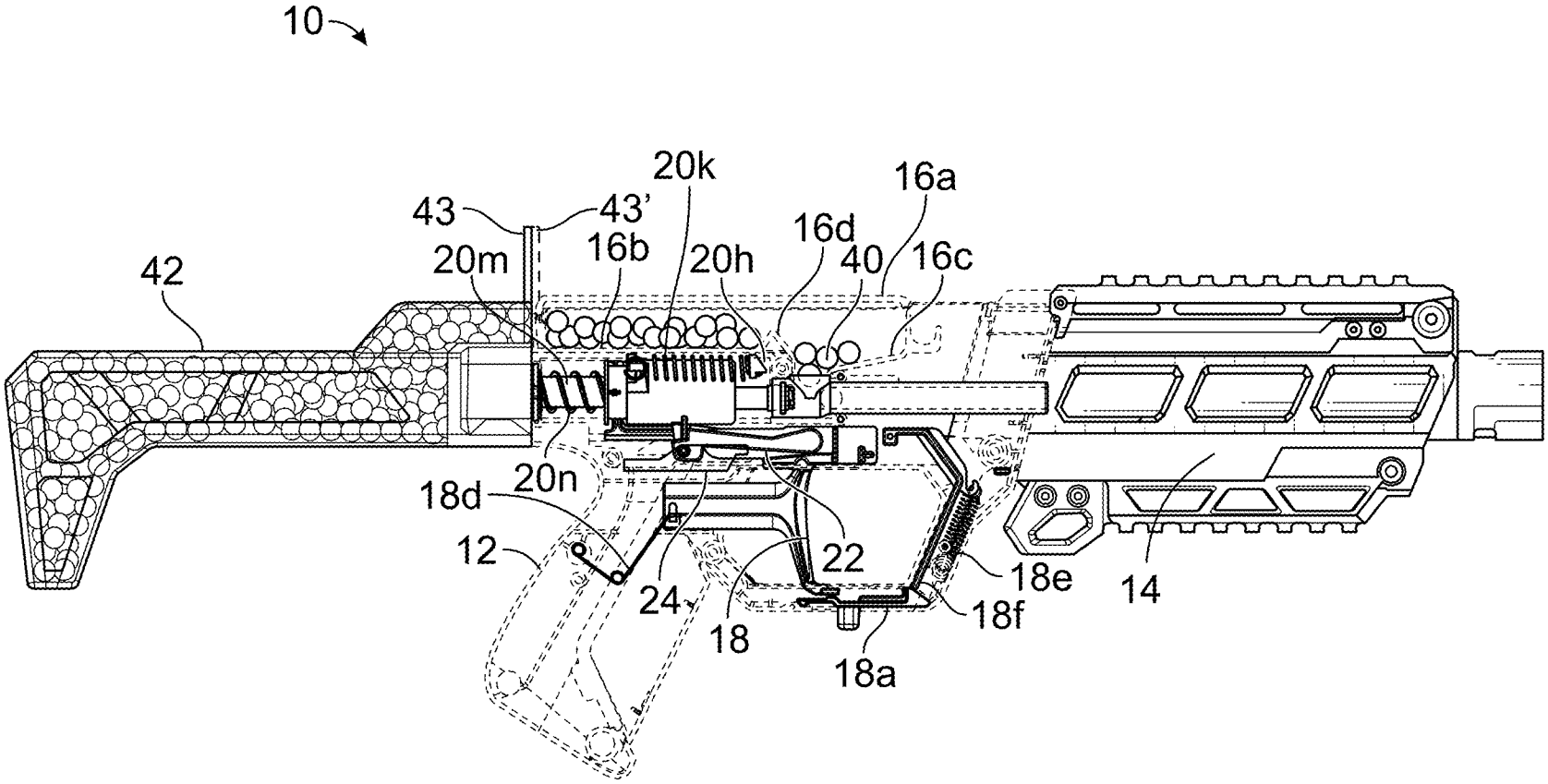
FIG. 4 show the blaster embodiment in side-elevation firing mechanism sectional and respective cylinder and piston cam pathway tracking/cam follower to advance a loading step of projectile firing functionally attached at the conveyor of the blaster in relation to a pre-firing area.

FIGS. 3, 4, 5, 6 and 7 show the blaster during operational steps respectively. Where FIG. 3 shows a first step of firing mechanism 20. FIG. 4 illustrates firing mechanism 20 where initial trigger 18 movement causes the cam follower linkages 22, 26 to start to retract breech bolt 20*a* and load projectile round 40 while starting to extend piston 20*k* at the second step. Herein the 4 show the blaster embodiment in side-elevation firing mechanism sectional and respective cylinder and piston cam pathway tracking/cam follower to advance a loading step of projectile firing functionally attached at the conveyor of the blaster in relation to a pre-firing area.

Figure 5:
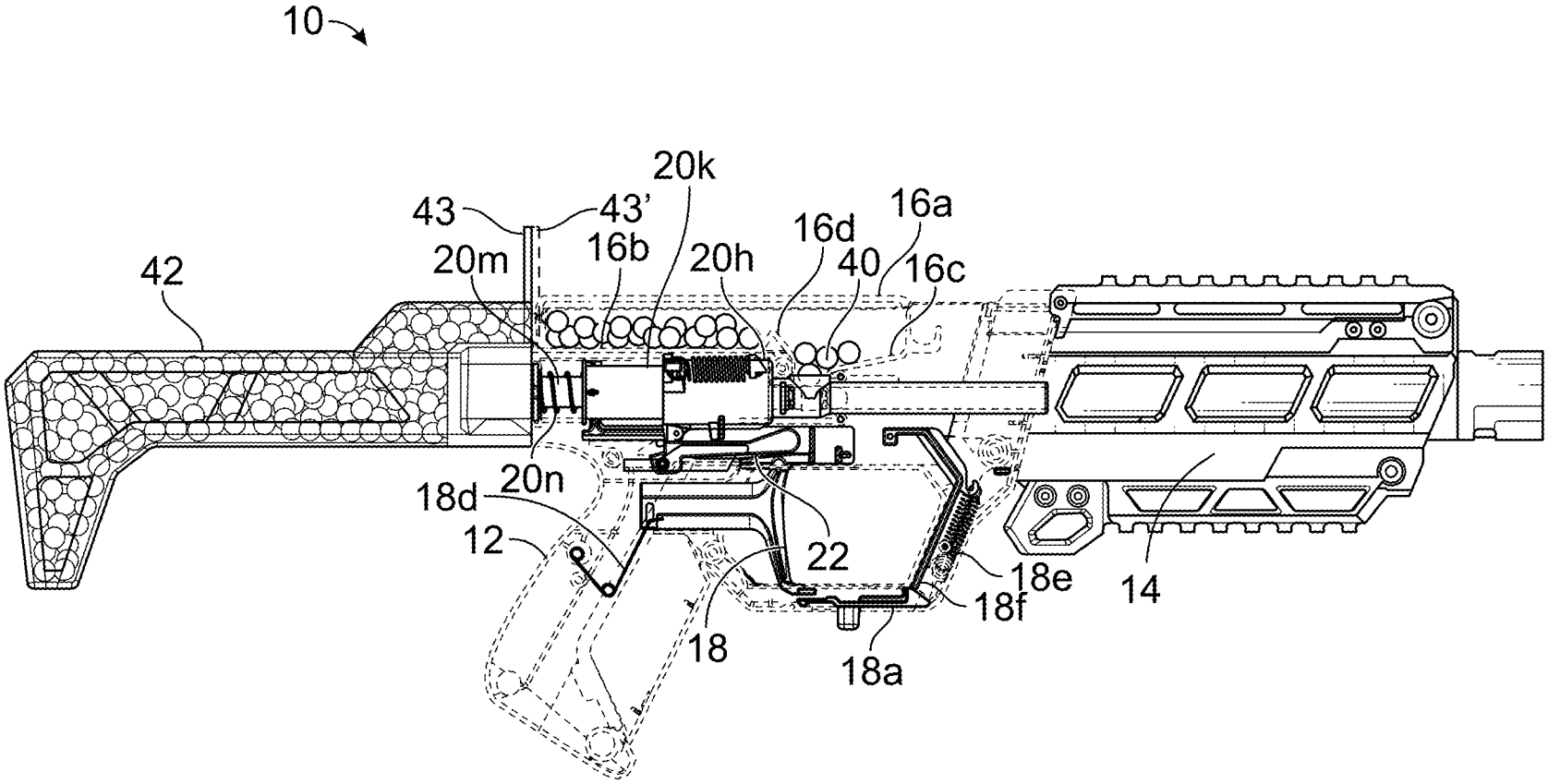
FIG. 5 show the blaster embodiment in side-elevation firing mechanism sectional and respective cylinder and piston cam pathway tracking/cam follower to advance a loading step of projectile firing functionally attached at the conveyor of the blaster in relation to a pre-firing area functionally attached at the conveyor of the blaster trigger.

FIG. 5 shows the blaster embodiment in side-elevation firing mechanism sectional and respective cylinder and piston cam pathway tracking/cam follower to advance a loading step of projectile firing functionally attached at the conveyor of the blaster in relation to a pre-firing area functionally attached at the conveyor of the blaster trigger.

Figure 6:
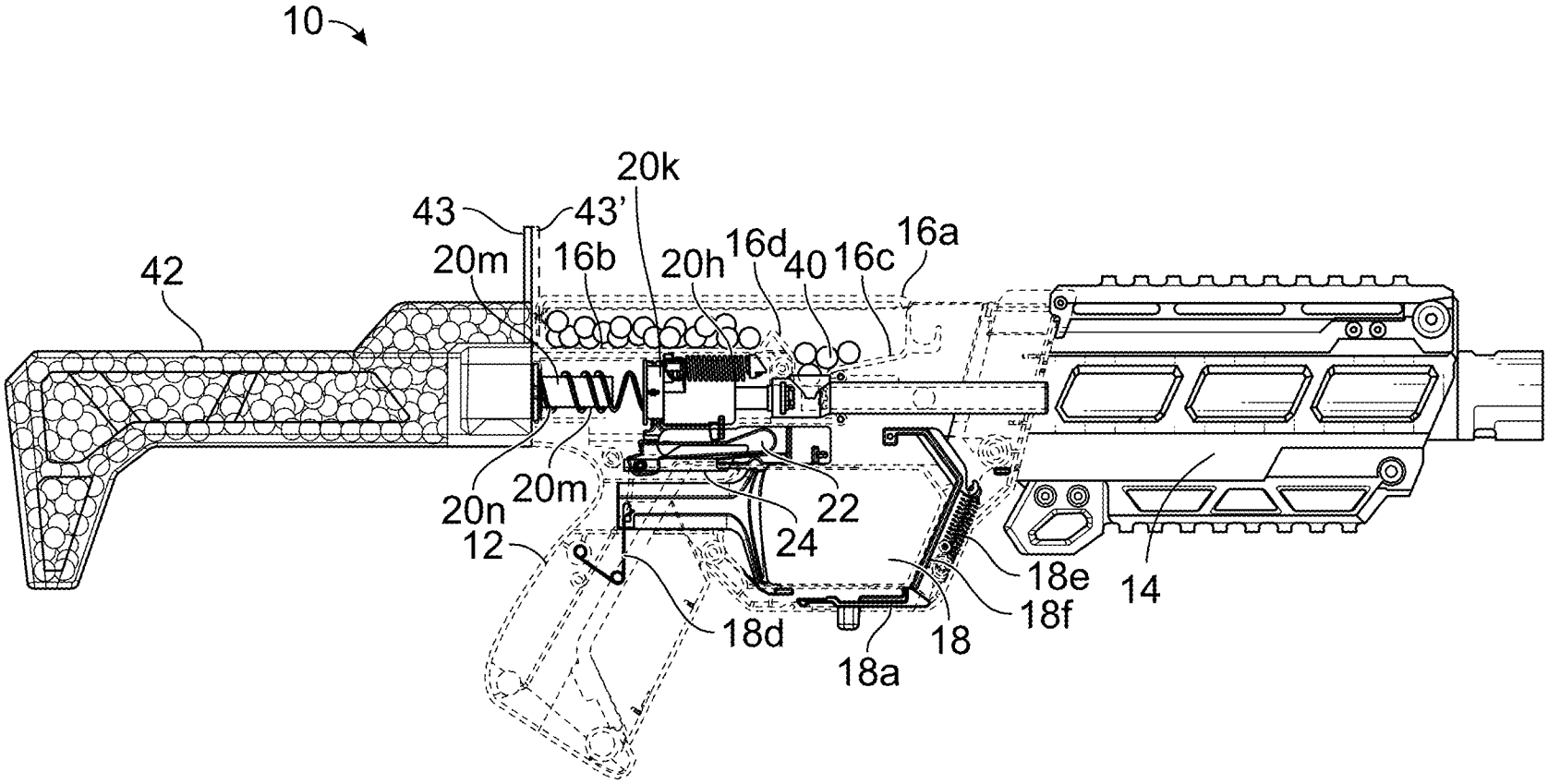
FIG. 6 show the blaster embodiment in side-elevation firing mechanism sectional and respective cylinder and piston cam pathway tracking/cam follower to advance a loading step of projectile firing functionally attached at the conveyor of the blaster in relation to a pre-firing area.

FIG. 6 show the blaster embodiment in side-elevation firing mechanism sectional and respective cylinder and piston cam pathway tracking/cam follower to advance a loading step of projectile firing functionally attached at the conveyor of the blaster in relation to a pre-firing area. The cylinder follower coupling 26*a* is already disengaged with the piston driving coupling 20*i* so the air compression element 20*s* remains in the advanced position. Therefore, the breech bolt 20*a* continues to seal the breech 20*d*. However, the piston follower coupling 26*a* disengages with piston driving coupling 20*r*. Therefore, the biasing force applied on piston 20*k* by the piston spring 20*n* causes the piston 20*k* to advance. The advance of the piston 20*k* is sudden causing the air within the air compression element 20*s* to compress. The compressed air exits the air compression element 20*s* through the breech bolt channel 20*w* which launches a gel round through the barrel seal 20*t* and barrel 20*c*.

Figure 7:
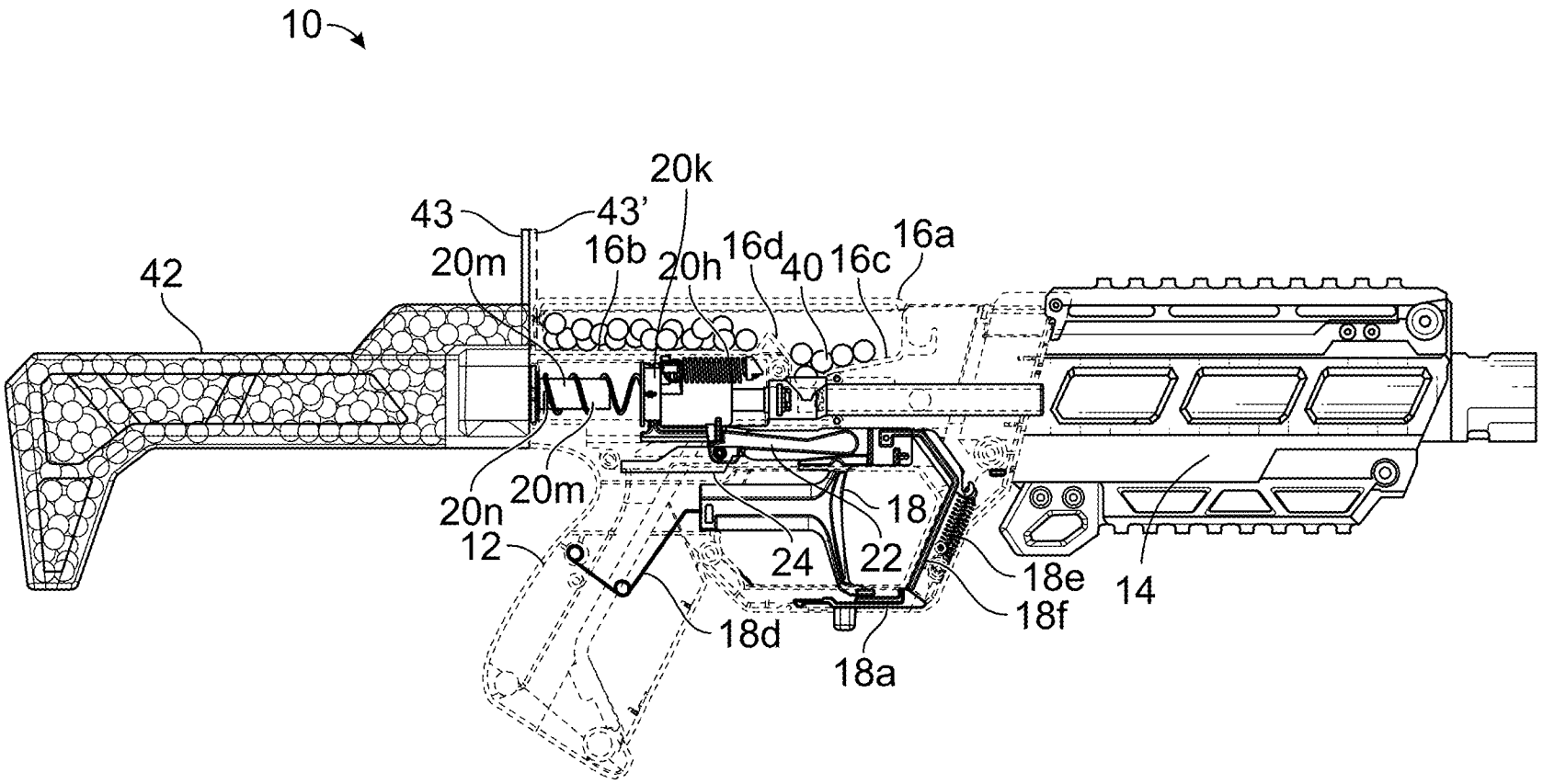
FIG. 7 show the blaster embodiment in side-elevation firing mechanism sectional and respective cylinder and piston cam pathway tracking/cam follower to advance a loading step of projectile firing functionally attached at the conveyor of the blaster in relation to a pre-firing area.

FIG. 7 show the blaster embodiment in side-elevation firing mechanism sectional and respective cylinder and piston cam pathway tracking/cam follower to advance a loading step of projectile firing functionally attached at the conveyor of the blaster in relation to a pre-firing area.

FIGS. 8A, 8B, and 8C show the use of the hopper with two separate areas facilitating reloading by tilting the blaster the use of the magazine back tray and magazine front hopper, such that rounds from the magazine front hopper will enter the breech of the blaster firing mechanism providing an interfacing hopper stock 42 projectiles magazine receptacle for holding multiple projectiles located distally along an upper or end portion of the a toy projectile blaster while tilting forward to replenish in relation to a pre-firing area for speed-tilt re-load in a Speed and Tilt Snap shoulder stock 42 re-load.

FIGS. 9, and 9A through 9G show a rearwardly attachable shoulder butt stock 42 hopper housing interface to blaster housing 30 with coupling to internal hopper 16*b* for a projectile launching element use of a speed load stock 42 additional shoulder or butt stock 42, such that rounds from the magazine hopper will enter the breech of the blaster firing mechanism for speed-tilt re-load in a Speed and Tilt Snap shoulder stock 42 re-load.

FIGS. 9H through 9M show an upwardly attachable gravity-feed snap-in/snap-out keyed hopper housing interface for insertion atop a blaster housing with coupling for a projectile launching element use of an alternative or additional speed load magazine. As disclosed are simply constructed with few and relatively inexpensive parts, providing quick and effective use with the toy projectile launcher and magazine interconnection apparatus as robust operational structure with either conventional or unconventional magazine hopper positioning, or with locations in unusual, angled orientations of the magazine to the launcher apparatus either atop or rearward thereof. Disclosed novel magazines facilitate quick and easy swapping of magazines or hoppers allowing projectile launcher interconnection and operation on the fly, further accommodating single hand user operation and quick release. As such that rounds from the magazine hopper will enter the breech of the blaster firing mechanism for speed re-load in a Speed and Snap In re-load.

Figure 10A:
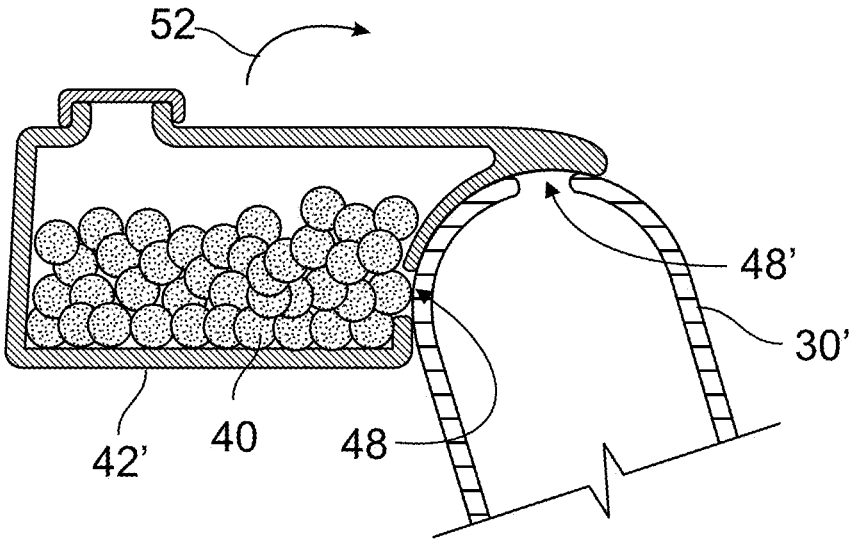
FIGS. 10A and 10B illustrate apparatus assembly operations where separate hopper 18 at the receptacle use extending or rotating flap door alternative interior wall to modify the capacity of hoppers in combination for advantageous and efficient configurable rotating barrier stock hopper at the firing mechanism housing for a projectile launching element use of a speed load stock additional hopper or magazine.
Figure 10B:
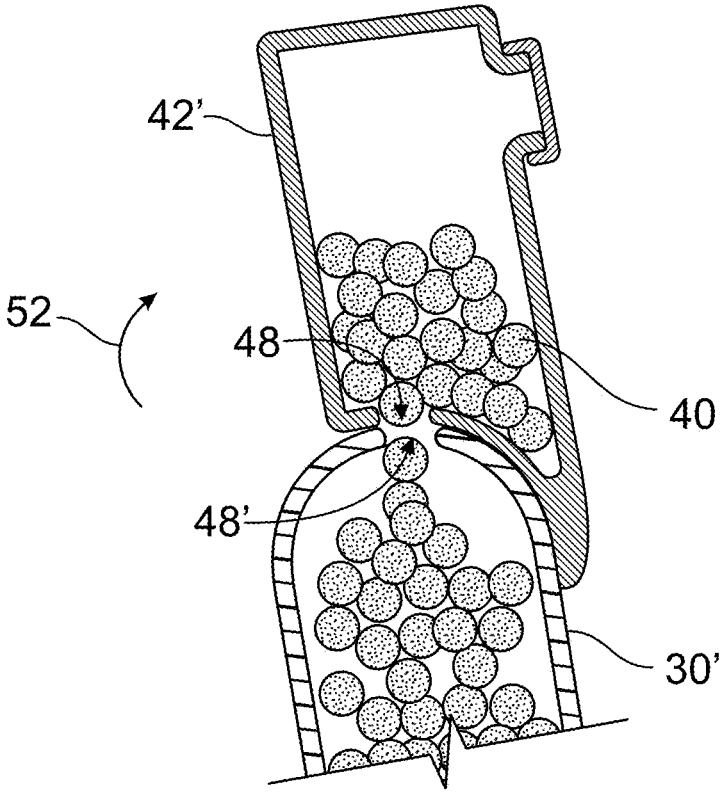

FIGS. 10A and 10B illustrate apparatus assembly operations where alternate hopper 42' at the receptacle use extending or rotating mating apertures 48, 48' interior walls side housings shown as 30' to modify the capacity of hoppers in combination for advantageous and efficient configurable rotating barrier stock 42 hopper at the firing mechanism housing for a projectile launching element use of a speed load stock 42 additional hopper or magazine. Additionally, the air compression element 20*s* and the piston 20*k* are fully advanced as the cam follower linkages also advanced. If at any step the trigger is returned to being fully advanced, the tracking ends will be high and the follower couplings will be in front of the driving couplings. The providing an interfacing hopper stock 42 projectiles magazine receptacle holds multiple projectiles located distally along an upper or end portion of the toy projectile blaster in relation to a pre-firing area respectively.

Figure 10D:
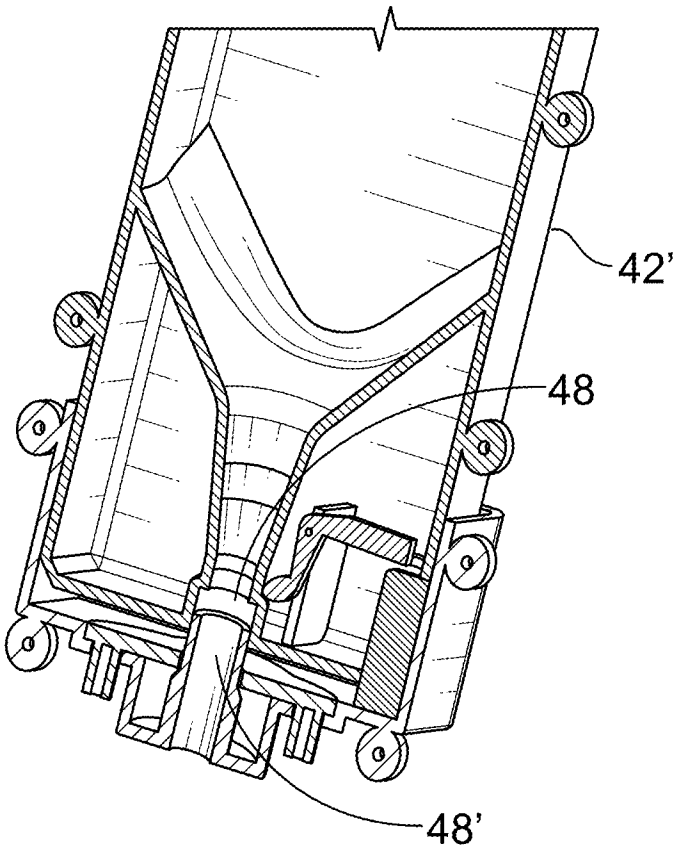
FIGS. 10C through 10G are sectional and assembly views of the hopper embodiments with internal feeding subassemblies. The top of the magazine hopper has a refill door and click in/out track for storage in the butt stock.
Figure 10C:
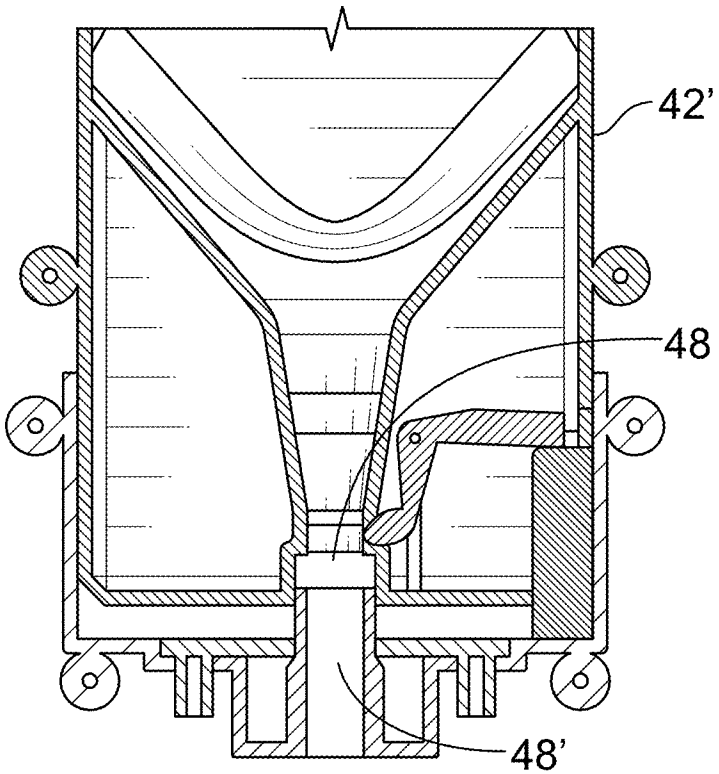
Figure 10E:
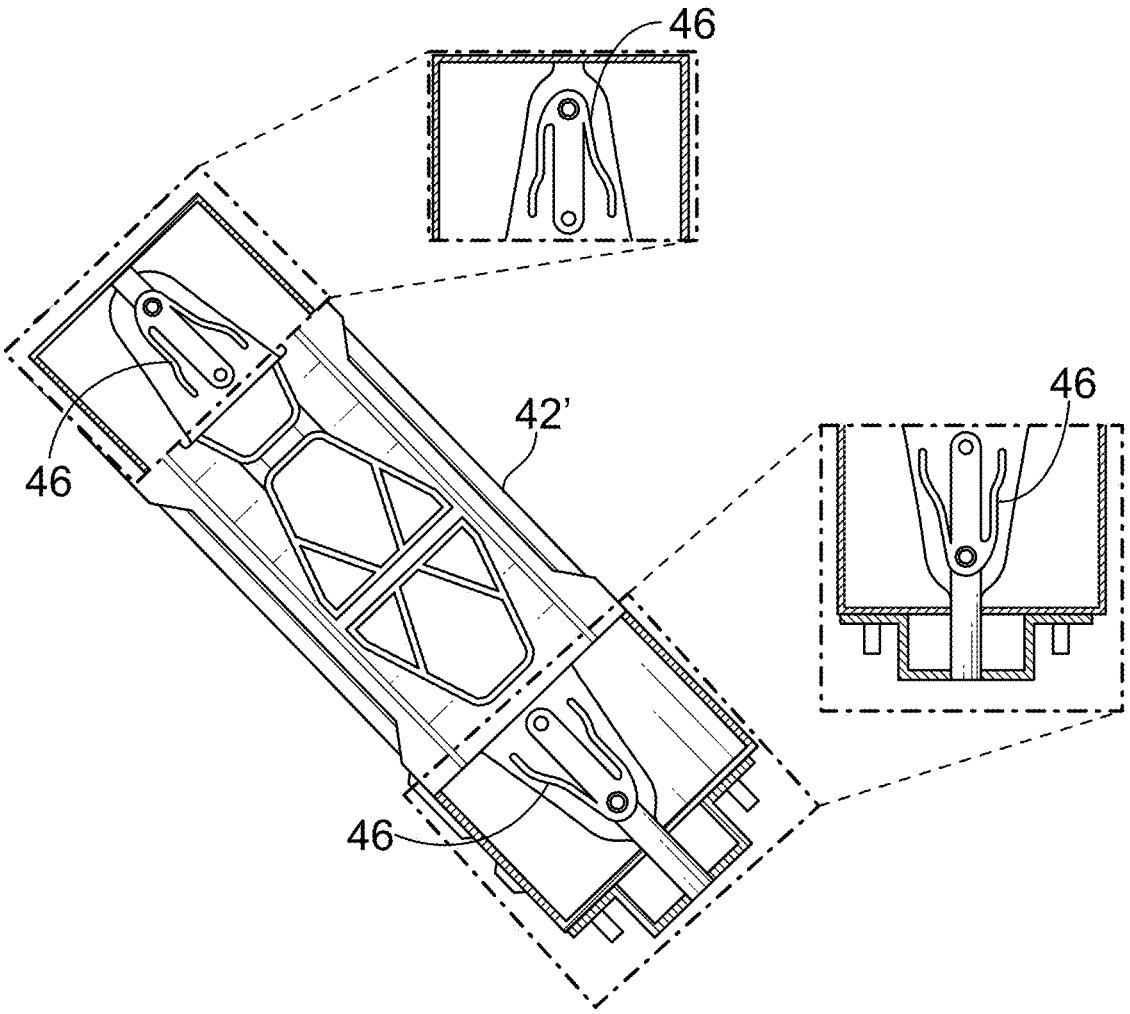

FIGS. 10C, 10D and 10E show the use of the hopper 43' separate areas facilitating reloading by tilting the blaster 10, such that rounds 40 from the magazine front hopper will enter the breech of the blaster firing mechanism 20, through the use of the magazine back tray 16*b* and magazine front hopper 16*c*. The two separate areas allow for a sort of reloading which is caused by tilting the blaster 10 with connected hopper apparatus along arrow line 50. Gel rounds 40 may reside in both the magazine back tray 16*b* and magazine front hopper 16*c*. However, only gel rounds 40 from the magazine front hopper 16*c* will enter the breech 20*d*. If the blaster 10 is fired enough, the front magazine tray 16*c* will eventually run out of gel rounds 40. With relatively few gel rounds 40 in the front magazine hopper 16*c*, the blaster 10 being relatively level thus until tilted gel rounds 40 in the magazine back tray 16*b* may not make it over the magazine separator 16*d*.

The toy projectile blaster removably interfaced with the shoulder or butt stock 42 receptacle hopper for multiple additional projectiles, user operable providing a hopper receptacle passageway in alignment with a firing projectile launching element to a projectile launching barrel for discharging projectiles. The channel in mechanical communication with the pre-firing area to the projectile launching element receiving projectiles from the hopper stock 42 projectiles magazine receptacle. The pre-firing area allows projectile rounds to be received, while coupling the hopper stock 42 projectiles magazine holds projectiles located distally along an upper portion of the pre-firing area for communication to outwardly launch the received projectile rounds. A user operable barrier at the hopper stock 42 projectiles magazine receptacle opens and feeds by gravity into the pre-firing area. The hopper stock 42 projectiles magazine receptacle tilts towards the breech 20*d* for feeding received projectile received into the pre-firing area. Accordingly, the methods described using the hopper stock 42 projectiles magazine receptacle structures directing firing mechanism housing, with tilting of the hopper stock 42 projectiles magazine receptacle for moving one or more projectiles towards the firing mechanism housing.

Figure 10F:
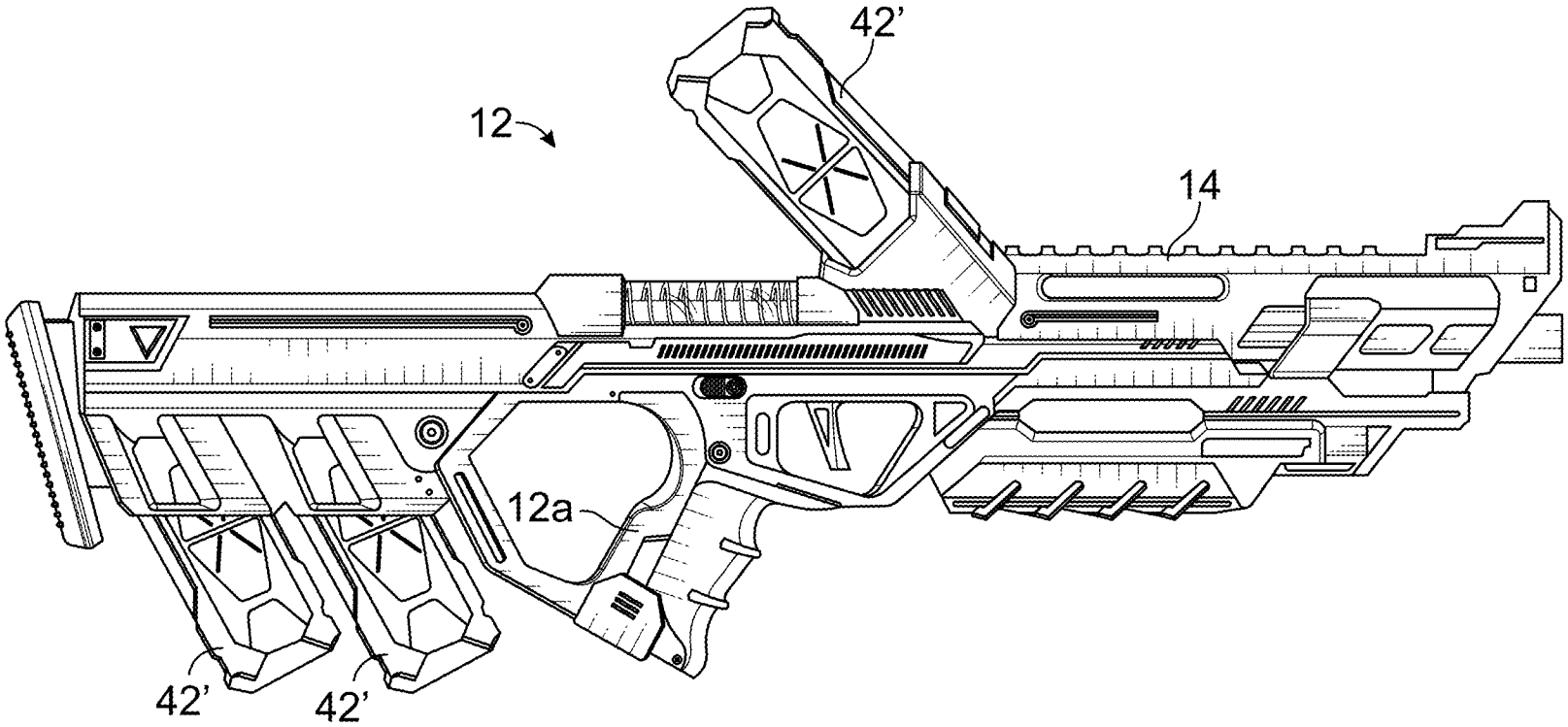
Figure 10G:
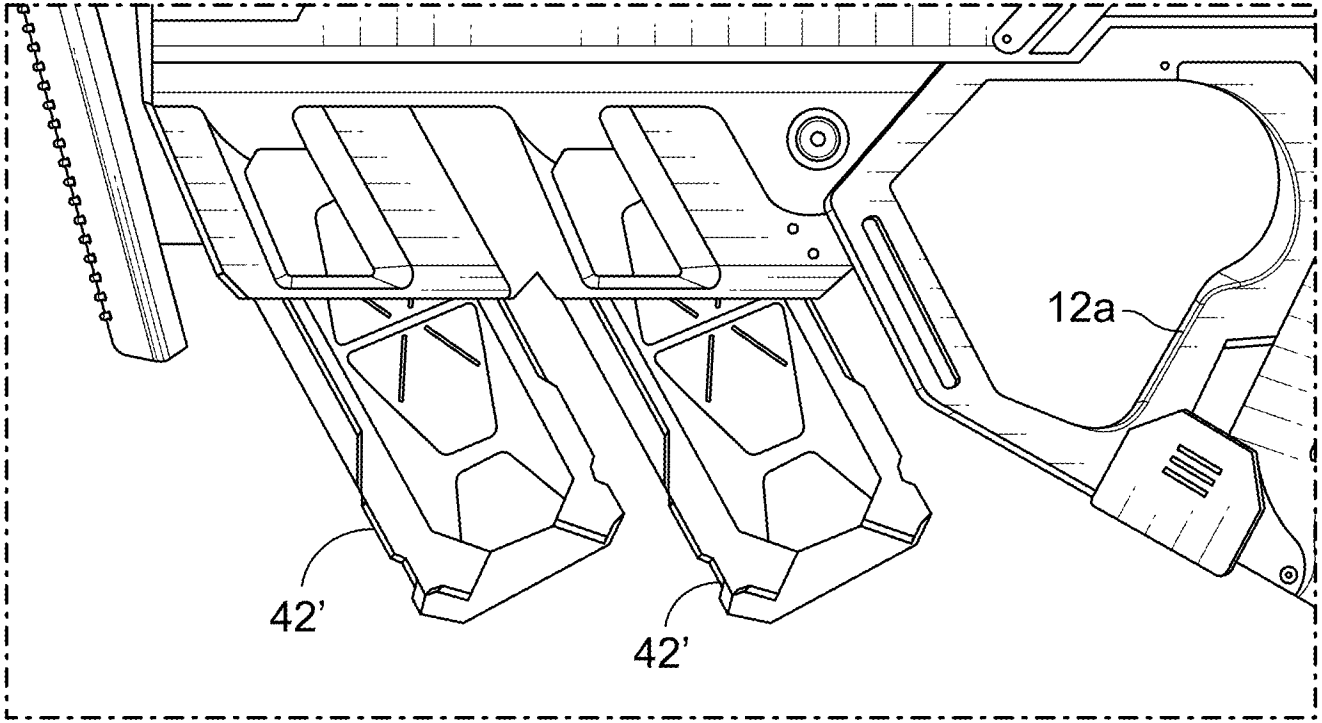

The use of a speed load stocks 42, 42' or additional shoulder or butt stock 42, male and female connectors, as well as magazine interface structures where attached accessory separatable additional hopper 42 at the receptacle use extending or rotating flap door alternative wall 43, 43' to mating apertures 48, 48' with mechanical communication to modify and limit the volume of the hopper for more efficient control using walls 43, 43' to mating apertures 48 with mechanical lever 44 communication to the hopper. As illustrated alternate vertical sectioned hopper apparatus hopper 42' may employ extending door interior wall 43, 43' separating the receptacle to modify and limit the volume of the hopper with user spring actuated interior door 43, 43' wall extending to close between hopper 42, 42' and the receptacle of the alignment module. FIGS. 10C through 10E provide sectional and assembly views of the hopper embodiments with alternative internal feeding subassemblies. The top of the magazine hopper has a refill door and click in/out track for storage in the butt stock. Further to FIGS. 10C and 10D with reference to FIGS. 9H through 9M, along with FIG. 10E, insertion is spring biased to push the magazine up to hold it in the locked position; with additional spring bias element magazine port compressed to engage and release cam track locking pin 46. As described a quick connect and quick release magazine (rectangular element) is inserted into an insertion element on the blaster housing (magazine port). FIGS. 10F and 10G assembly views of magazines 42' hopper embodiments feeding subassemblies. The top of the magazine hopper has a refill door and click in/out track for storage in the butt stock. When the magazine is inserted, it pushes against a biased plate, against an upwardly biased force or spring, ensuring the pin 46 remains in the proper location at rest until the user pushes the magazine in and the pin 46 is biased to be removed from the path in a counterclockwise fashion to enable Magazine removal. The insertion box includes a shaped slot that contains a pivotable pin 46 structure that is shown with two biasing/alignment arms. The arms function (if present) to ensure the pin 46 (connected to the same piece of plastic as the arms) is directed counterclockwise around the "island" surfaces in the path on the magazine housing. The pivoting element with the biasing/alignment arms are that hold the pin 46, the shape of the "Island" in the Path and the width of the path, as structured in the Figures. For example, pin 46 could project from a pivoting element that does not have arms at all. With pin 46 extending into the island in the middle of the path could have a heavier angle such that its interaction with the pin 46 (no biasing/alignment arms) would be directed counterclockwise in the path. The path on the magazine illustrated could also be tapered to ensure the correct direction of pin 46 around the island at insertion.

As illustrated herein multiple apparatus assembly geometries, and operations where separate hopper 42, 42' at the receptacle use extending or rotating flap door alternative interior wall 43, 43' to modify and limit the and reconfigured to shoulder stock 42 hopper/extended magazine with flap door structures hopper for efficient control over transfer between the mentioned hoppers interconnecting structures herein. The channel 48 in mechanical communication receives projectiles from the hopper stock 42 projectiles magazine receptacle. The tilting function, when the stock magazine 42, hoppers 16 with magazine separator 16*d* raised above the breech 20*d* being low, back stock opening door 43, 43' are released to admit more projectiles 40 geometry such that simply opening once while tilting forward replenish for speed-tilt re-load in a Speed and Tilt Snap shoulder stock 42 re-load. As illustrated alternate hopper receptacle configurations operate as, e.g., rotational hopper apparatus along arrow line 52 apparatus assembly operations where separate hopper 42, 42' at the receptacle use extending or rotating flap door/gate wall alternative interior wall 43, 43' to modify and limit the volume of the hopper. These illustrate an alternative vertical sectioned hopper apparatus hopper 18 employing rotating or extending door interior wall barriers of the hopper with user finger spring actuated interior door 43, 43' wall extending to close between hopper 42' and the receptacle of the alignment module.

While particular embodiments of the inventions have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launching system, comprising:

a firing mechanism housing for a projectile launching element;

a projectile launching barrel for discharging plural projectile rounds;

a pre-firing area allowing the plurality of the projectile rounds to be received from a separator junction where a channel in mechanical communication with the pre-firing area aligns at least one received projectile at the projectile launching barrel with the projectile launching element defined to include a breech;

an air compression element at the projectile launching element including a cylinder and an elongated breech bolt, the breech bolt having a proximal end at the cylinder and a breech bolt channel extending therethrough for fluid communication from the cylinder through the breech bolt for expelling compressed air from a distal end of the breech bolt, the cylinder having a cylinder driving coupling;

a piston slidably received at the cylinder of the air compression element, the piston having a piston driving coupling;

a cylinder cam pathway track at the firing mechanism housing;

a piston cam pathway track at the firing mechanism housing;

a trigger assembly including a conveyor;

a piston cam follower linkage having a tracking end at the piston cam pathway track, a piston trigger end pivoted at the conveyor, and a piston follower coupling for engaging the piston driving coupling;

a cylinder cam follower linkage having a tracking end at the cylinder cam pathway track, a cylinder trigger end pivoted at the conveyor, and a cylinder follower coupling for engaging the cylinder driving coupling; and a hopper stock projectiles magazine receptacle for holding multiple projectiles located distally along an upper portion of the pre-firing area.

2. The toy launching system of claim 1, wherein the breech receives the at least one received projectile by gravity into the pre-firing area.

3. The toy launching system of claim 1, wherein the hopper stock projectiles magazine receptacle tilts towards the breech for feeding the at least one received projectile received into the pre-firing area.

4. The toy launching system of claim 1, comprising a breech spring and a piston spring, the piston spring being compressed by the piston follower coupling contacting the piston driving coupling actuated by the conveyor of the trigger assembly upon pulling of the trigger engaging the piston cam follower linkage, the cylinder follower coupling contacting the cylinder driving coupling actuated by the conveyor engaging the cylinder cam follower linkage for withdrawing the breech bolt of the air compression element from the breech of the pre-firing area, the breech spring being connected to and extending with the air compression element.

5. The toy launching system of claim 4, comprising a trigger spring, the breech spring connected to the air compression element upon further pulling of the trigger moving the conveyor to disengage the cylinder cam follower linkage releasing the breech spring for extending the breech bolt of the air compression element into the pre-firing area, with the trigger spring returning the conveyor of the trigger assembly upon release of the trigger.

6. The toy launching system of claim 5, wherein further pulling of the trigger moves the conveyor to disengage the piston cam follower linkage releasing the piston spring for advancing the piston in the cylinder of the air compression element into the pre-firing area, with the trigger spring returning the conveyor of the trigger assembly upon release of the trigger for advancing the piston, causing compressed air to expel through the breech bolt channel extending through the breech bolt for expelling compressed air from the distal end of the breech bolt, and outwardly launch the one or more projectiles through the barrel seal and the projectile launching barrel.

7. A toy launching apparatus, comprising:

a firing mechanism housing for a projectile launching element;

a hopper stock projectiles magazine receptacle for holding multiple projectiles removably interfacing distally along an upper portion of the firing mechanism housing;

a projectile launching barrel for discharging plural projectile rounds;

a pre-firing area allowing the plurality of the projectile rounds to be received for discharge with the projectile launching element through the projectile launching barrel, said hopper stock projectiles magazine receptacle for holding multiple projectiles located distally along an upper portion of the pre-firing area;

a channel in mechanical communication with the firing mechanism housing to the projectile launching element receiving projectiles from the hopper stock projectiles magazine receptacle, the firing mechanism housing extending a separator junction between the channel and the projectile launching element separating at least one held projectile from the hopper stock projectiles magazine receptacle for delivery to a breech defined with the projectile launching element;

an air compression element at the projectile launching element including a cylinder and a cylinder driving coupling;

a piston slidably received at the cylinder of the air compression element, the piston having a piston driving coupling;

a cylinder cam pathway track at the firing mechanism housing;

a piston cam pathway track at the firing mechanism housing;

a trigger assembly including a conveyor;

a piston cam follower linkage having a tracking end at the piston cam pathway track, a piston trigger end pivoted at the conveyor, and a piston follower coupling for engaging the piston driving coupling; and a cylinder cam follower linkage having a tracking end at the cylinder cam pathway track, a cylinder trigger end pivoted at the conveyor, and a cylinder follower coupling for engaging the cylinder driving coupling.

8. The toy launching apparatus of claim 7, comprising a rearwardly attachable shoulder butt stock hopper at the firing mechanism housing for a projectile launching element.

9. The toy launching apparatus of claim 7, comprising a magazine clip at the breech for feeding one or more projectiles received into the pre-firing area.

10. The toy launching apparatus of claim 7, comprising a user operable interface wherein the hopper stock projectiles magazine receptacle is removeable.

11. The toy launching apparatus of claim 7, wherein the separator junction enables a user operable barrier at the hopper stock projectiles magazine receptacle for receiving one or more projectiles by gravity into the pre-firing area.

12. The toy launching apparatus of claim 11, wherein tilting the hopper stock projectiles magazine receptacle moves one or more projectiles towards the firing mechanism housing.

13. The toy launching apparatus of claim 12, wherein a hopper stock projectiles magazine receptacle is coupled distally for holding multiple projectiles along an upper portion of the pre-firing area.

14. The toy launching apparatus of claim 7, comprising an air compression element including cylinder and an elongated breech bolt, the breech bolt having a proximal end at the cylinder and a breech bolt channel extending therethrough for fluid communication from the cylinder through the breech bolt for expelling compressed air from a distal end of the breech bolt, the cylinder having a cylinder driving coupling.

15. The toy launching apparatus of claim 7, said channel being in mechanical communication with the pre-firing area to the projectile launching element receiving projectiles from the hopper stock projectiles magazine receptacle.

16. The toy launching apparatus of claim 15, wherein said pre-firing area is defined to include the separator junction between the channel and the projectile launching element.

17. The toy launching apparatus of claim 16, wherein the separator junction between the channel and the projectile launching element aligns at least one received projectile at the projectile launching barrel with the breech defined with the projectile launching element.

18. A toy launching method, comprising the steps of:

providing a firing mechanism housing for a projectile launching element; positioning a projectile launching barrel for discharging plural projectile rounds;

arranging a pre-firing area allowing the plurality of the projectile rounds to be received for discharge with the projectile launching element through the projectile launching barrel, said projectile launching element defined to include a breech and a separator channel in mechanical communication with the pre-firing area enabled to align at least one received projectile at the projectile launching barrel with the breech of the projectile launching element;

coupling an air compression element at the projectile launching element with a cylinder and a cylinder driving coupling;

slidably receiving a piston at the cylinder of the air compression element, the piston having a piston driving coupling;

defining a cylinder cam pathway track at the firing mechanism housing;

defining a piston cam pathway track at the firing mechanism housing;

moving a conveyor with a trigger assembly with a piston cam follower linkage having a tracking end at the piston cam pathway track, a piston trigger end at the conveyor, and a piston follower coupling for engaging the piston driving coupling with a cylinder cam follower linkage having a tracking end at the cylinder cam pathway track, a cylinder trigger end at the conveyor, and a cylinder follower coupling for engaging the cylinder driving coupling; and coupling a hopper stock projectiles magazine receptacle for holding multiple projectiles located distally along an upper portion of the pre-firing area.

19. The toy launching method of claim 18, further comprising:

enabling the projectile launching element to align at least one received projectile at the projectile launching barrel.

20. The toy launching method of claim 19, wherein the receiving step comprises:

providing the hopper stock projectiles magazine receptacle as removeable from firing mechanism housing; and tilting the hopper stock projectiles magazine receptacle for moving one or more projectiles towards the firing mechanism housing.

* * * * *